US005970628A

United States Patent [19]

Meschan

[11] Patent Number: 5,970,628

[45] Date of Patent: Oct. 26, 1999

[54] ATHLETIC SHOE WITH IMPROVED HEEL STRUCTURE

[75] Inventor: David F. Meschan, Greensboro, N.C.

[73] Assignee: Akeva L.L.C., Greensboro, N.C.

[21] Appl. No.: 09/149,142

[22] Filed: Sep. 8, 1998

Related U.S. Application Data

[63] Continuation of application No. 08/542,251, Oct. 12, 1995, Pat. No. 5,806,210.

[51] Int. Cl.[6] ..... A43B 21/36; A43B 21/32; A43B 21/24

[52] U.S. Cl. ..... 36/42; 36/39; 36/36 R; 36/36 A; 36/27; 36/31; 36/35 R; 36/15; 36/37

[58] Field of Search ..... 36/42, 39, 36 R, 36/36 A, 27, 31, 35 R, 15, 37, 69, 41, 36 C, 34 R, 25 R, 100, 101, 103, 105, 38

[56] References Cited

U.S. PATENT DOCUMENTS

| | | |
|---|---|---|
| Re. 33,648 | 7/1991 | Brown . |
| 48,682 | 7/1865 | Hayward et al. . |
| 221,592 | 11/1879 | Mitchell et al. . |
| 537,492 | 4/1895 | Smith . |
| 652,887 | 7/1900 | Butterfield . |
| 674,636 | 5/1901 | Priestman . |
| 789,089 | 5/1905 | Frank . |
| 818,861 | 4/1906 | Beck et al. . |
| 1,046,815 | 12/1912 | Lavoie . |
| 1,062,338 | 5/1913 | Kane . |
| 1,112,635 | 10/1914 | May . |
| 1,316,505 | 9/1919 | O'Neill . |
| 1,318,247 | 10/1919 | Victor . |
| 1,346,841 | 7/1920 | Padden . |
| 1,366,601 | 1/1921 | Sellars . |
| 1,371,339 | 3/1921 | Arntz et al. . |
| 1,410,064 | 3/1922 | Hunt . |
| 1,439,757 | 12/1922 | Redman . |
| 1,439,758 | 12/1922 | Redman . |
| 1,444,677 | 2/1923 | Fischer . |
| 1,458,257 | 6/1923 | Van Melle . |

(List continued on next page.)

FOREIGN PATENT DOCUMENTS

| | | |
|---|---|---|
| 533972 | 3/1922 | France . |
| 648339 | 7/1937 | Germany . |
| 693394 | 7/1940 | Germany . |
| 947054 | 7/1956 | Germany . |
| 2154951 | 5/1973 | Germany . |
| 2742138 | 3/1979 | Germany . |
| 434029 | 10/1967 | Switzerland . |
| 25728 | 11/1909 | United Kingdom . |
| 83342 | 2/1911 | United Kingdom . |
| 229 884 | 3/1924 | United Kingdom . |
| 1540926 | 2/1979 | United Kingdom . |
| 2 144 024 | 2/1985 | United Kingdom . |

OTHER PUBLICATIONS

"New Footwear Concepts" by E.I. du Pont de Nemours & Co. (1988).

Etonic Spring 1996 Footwear catalogue.

International Search Report for International Appln. PCT/US94/09001 dated Jan. 2, 1995.

*Primary Examiner*—Ted Kavanaugh

*Attorney, Agent, or Firm*—Finnegan, Henderson, Farabow, Garrett & Dunner, L.L.P.

[57] ABSTRACT

A shoe includes a rear sole support for receiving a replaceable rear sole to provide longer wear. The shoe may also include a flexible plate supported by the rear sole support between the heel and the rear sole to reduce midsole compression and provide additional spring. A mounting member secures the rear sole to the rear sole support, and a locking member prevents rotation of the rear sole relative to the rear sole support during use. The replaceable rear sole and the flexible plate allow the shoe to be adapted to different desired performance characteristics depending upon the intended activity and terrain or playing surface.

46 Claims, 29 Drawing Sheets

U.S. PATENT DOCUMENTS

| | | |
|---|---|---|
| 1,479,773 | 1/1924 | Craig . |
| 1,516,384 | 11/1924 | Kamada . |
| 1,542,174 | 6/1925 | Robidoux . |
| 1,611,024 | 12/1926 | Grimaldi . |
| 1,721,714 | 8/1929 | Ross . |
| 2,002,087 | 5/1935 | Esterson . |
| 2,078,311 | 4/1937 | Boag . |
| 2,208,260 | 7/1940 | Hayden . |
| 2,288,168 | 6/1942 | Leu . |
| 2,300,635 | 11/1942 | Shepherd . |
| 2,374,954 | 5/1945 | Pipitone . |
| 2,500,302 | 3/1950 | Vicente . |
| 2,540,449 | 2/1951 | Kaufman . |
| 2,556,842 | 3/1951 | Gilmour . |
| 2,607,134 | 1/1952 | Langer . |
| 2,628,439 | 2/1953 | Rochlin . |
| 2,707,341 | 5/1955 | Romano . |
| 2,745,197 | 1/1956 | Holt . |
| 2,806,302 | 9/1957 | Sharpe . |
| 2,998,661 | 9/1961 | Israel . |
| 3,083,478 | 4/1963 | Rakus . |
| 3,085,359 | 4/1963 | Rubens . |
| 3,087,265 | 4/1963 | McKinley . |
| 3,171,218 | 3/1965 | D'Urbano . |
| 3,208,163 | 9/1965 | Rubens . |
| 3,237,321 | 3/1966 | McKinley . |
| 3,271,885 | 9/1966 | McAuliffe . |
| 3,318,025 | 5/1967 | Antelo . |
| 3,432,158 | 3/1969 | McMahon et al. . |
| 3,455,038 | 7/1969 | Kasdan . |
| 3,478,447 | 11/1969 | Gillead . |
| 3,514,879 | 6/1970 | Frattallone . |
| 3,566,489 | 3/1971 | Morley . |
| 3,593,436 | 7/1971 | Vietas . |
| 3,646,497 | 2/1972 | Gillikin . |
| 3,664,041 | 5/1972 | Frattallone . |
| 3,775,874 | 12/1973 | Bonneville . |
| 3,782,010 | 1/1974 | Frattallone . |
| 3,928,881 | 12/1975 | Bente . |
| 3,988,840 | 11/1976 | Minihane . |
| 4,062,132 | 12/1977 | Klimaszewski . |
| 4,067,123 | 1/1978 | Minihane . |
| 4,098,011 | 7/1978 | Bowerman . |
| 4,214,384 | 7/1980 | Gonalez . |
| 4,224,749 | 9/1980 | Diaz-Cano . |
| 4,262,434 | 4/1981 | Michelotti . |
| 4,263,728 | 4/1981 | Frecentese . |
| 4,267,650 | 5/1981 | Bauer . |
| 4,322,894 | 4/1982 | Dykes . |
| 4,322,895 | 4/1982 | Hockerson . |
| 4,363,177 | 12/1982 | Boros . |
| 4,372,058 | 2/1983 | Stubblefield . |
| 4,377,042 | 3/1983 | Bauer . |
| 4,378,643 | 4/1983 | Johnson . |
| 4,393,605 | 7/1983 | Spreng . |
| 4,399,620 | 8/1983 | Funck . |
| 4,414,763 | 11/1983 | Bente . |
| 4,429,474 | 2/1984 | Metro . |
| 4,449,307 | 5/1984 | Stubblefield . |
| 4,455,766 | 6/1984 | Rubens . |
| 4,510,700 | 4/1985 | Brown . |
| 4,541,185 | 9/1985 | Chou . |
| 4,546,556 | 10/1985 | Stubblefield . |
| 4,550,510 | 11/1985 | Stubblefield . |
| 4,598,487 | 7/1986 | Misevich . |
| 4,606,139 | 8/1986 | Silver . |
| 4,608,768 | 9/1986 | Cavanagh . |
| 4,610,100 | 9/1986 | Ungar . |
| 4,622,764 | 11/1986 | Boulier . |
| 4,638,575 | 1/1987 | Illustrato . |
| 4,680,876 | 7/1987 | Peng . |
| 4,706,392 | 11/1987 | Yang . |
| 4,709,489 | 12/1987 | Welter . |
| 4,741,114 | 5/1988 | Stubblefield . |
| 4,745,693 | 5/1988 | Brown . |
| 4,778,717 | 10/1988 | Fitchmun . |
| 4,785,557 | 11/1988 | Kelley et al. . |
| 4,811,500 | 3/1989 | Maccano . |
| 4,866,861 | 9/1989 | Noone . |
| 4,875,300 | 10/1989 | Kazz . |
| 4,879,821 | 11/1989 | Graham et al. . |
| 4,881,329 | 11/1989 | Crowley . |
| 4,887,367 | 12/1989 | Mackness et al. . |
| 4,936,028 | 6/1990 | Posacki . |
| 4,979,319 | 12/1990 | Hayes . |
| 4,995,173 | 2/1991 | Spier . |
| 5,005,300 | 4/1991 | Diaz et al. . |
| 5,070,629 | 12/1991 | Graham et al. . |
| 5,083,385 | 1/1992 | Halford . |
| 5,086,574 | 2/1992 | Bacchiocchi . |
| 5,092,060 | 3/1992 | Frachey et al. . |
| 5,185,943 | 2/1993 | Tong et al. . |
| 5,224,277 | 7/1993 | Sang Do . |
| 5,255,451 | 10/1993 | Tong et al. . |
| 5,319,866 | 6/1994 | Foley et al. . |
| 5,381,608 | 1/1995 | Claveria . |
| 5,402,588 | 4/1995 | Graham et al. . |
| 5,560,126 | 10/1996 | Meschan et al. . |
| 5,615,497 | 4/1997 | Meschan . |
| 5,806,210 | 9/1998 | Meschan . |

ATHLETIC SHOE WITH IMPROVED HEEL STRUCTURE

This is a continuation of application Ser. No. 08/542,251, filed Oct. 12, 1995 now U.S. Pat. No. 5,806,210.

BACKGROUND OF THE INVENTION

1. Field of the Invention

The present invention relates generally to multi-purpose athletic shoes and, more particularly, to athletic shoes with interchangeable/detachable rear soles that provide extended and more versatile life and better performance in terms of cushioning and spring.

2. Discussion of the Related Art

Athletic shoes, such as those designed for running, tennis, basketball, cross-training, hiking, walking, and other forms of exercise, typically include a laminated sole attached to a soft and pliable upper. The sole usually includes an abrasion-resistant, rubber outsole attached to a cushioning midsole usually made of polyurethane, ethylene vinyl acetate (EVA), or a rubber compound.

One of the principal problems associated with athletic shoes is wear to both the outsole and midsole. A user rarely has a choice of running or playing surfaces, and asphalt and other abrasive surfaces take a tremendous toll on the outsole. This problem is exacerbated by the fact that, with the exception of the tennis shoe, the most pronounced outsole wear for most users, on running shoes in particular, occurs principally in two places: the outer periphery of the heel and the ball of the foot, with heel wear being, by far, a more acute problem because of the great force placed on the heel during the gait cycle. In fact, the heel typically wears out much faster than the rest of the athletic shoe, thus requiring replacement of the entire shoe even though the bulk of the shoe is still in satisfactory condition.

Midsole wear, on the other hand, results not from abrasive forces, but from repeated compression of the resilient material forming the midsole due to the large force exerted on it during use, thereby causing it to lose its cushioning effect. Midsole compression is also the worst in the heel area, particularly the outer periphery of the heel directly above the outsole wear spot and the area directly under the user's calcaneus or heel bone.

Despite higher prices and increased specialization, no one has yet addressed heel wear problems in an effective way. To date, there is nothing in the art to address the combined problems of midsole compression and outsole wear in athletic shoes, and these problems remain especially severe in the heel area of such shoes.

Designs are known that specify the replacement of the entire outsole of a shoe. Examples include those disclosed in U.S. Pat. Nos. 4,745,693, 4,377,042 and 4,267,650. These concepts are impractical for most applications, however, especially athletic shoes, for several reasons. First, tight adherence between the sole and the shoe is difficult to achieve, particularly around the periphery of the sole. Second, replacement of the entire sole is unnecessary based upon typical wear patterns in athletic shoes. Third, replacing an entire sole is or would be more expensive than replacing simply the worn elements, a factor which is compounded if a replaceable, full-length sole for every men's and women's shoe size is to be produced. Finally, it would appear that the heel section, in particular, has entirely different needs and requirements from the rest of the shoe sole which derive in substantial part from its rate of deterioration.

Other designs, which are principally directed to shoes having a relatively hard heel and outsole (e.g., dress shoes), disclose rear soles that are detachable and which can be rotated when a portion of the rear sole becomes worn. Such designs, however, have never caught on in the marketplace because it is simply too easy and relatively inexpensive to have the entire heel on such footwear replaced at a commercial shoe repair shop.

It is difficult to adapt such "dress shoe" designs to athletic shoes for various reasons. One reason is that the soft, resilient materials utilized in athletic shoe soles make it extremely difficult to devise a mechanism for detachably securing heel elements to each other without adversely affecting the cushioning and other desired properties of the shoe. On the other hand, utilization of hard materials in athletic shoes tends to increase weight and decrease comfort and performance.

For example, U.S. Pat. No. 1,439,758 to Redman discloses a detachable rear sole that is secured to a heel of the shoe with a center screw that penetrates the bottom of the rear sole and which is screwed into the bottom of the heel of the shoe. Such a design cannot be used in athletic shoes because the center screw would detrimentally affect the cushioning properties of the resilient midsole and may possibly be forced into the heel of the user when the midsole is compressed during use. Furthermore, a center screw does little for peripheral adherence of the sole to the shoe heel in the case of resilient materials.

Another truism in the athletic shoe industry is that, while cushioning has received a lot of attention, spring has received very little, despite the fact that materials like graphite and various forms of graphite composite possess the proper characteristics for spring enhancement without increasing weight. One reason may be the perceived tendency of graphite or graphite composite to crack under stress. Yet another reason may be the increased cost associated with such materials. Yet another reason may be that the tremendous variation in body weight and spring preference of would-be users makes it commercially unfeasible to mass-market athletic shoes with graphite spring enhancement, given the countless options that would have to be offered with each shoe size. Since heel spring is largely ignored, it goes without saying that spring options are also non-existent.

Also absent from the marketplace are truly multi-purpose athletic shoes. Notwithstanding a few "run-walk," "aerobic-run," and all-court models, the unmistakable commercial trend appears to be increased specialization, with no apparent industry awareness of the fact that the use and function of an athletic shoe can be changed dramatically if it is simply given interchangeable rear soles. Similarly, no athletic shoe manufacturer has yet to offer varying heel cushioning firmness in each shoe size, despite the fact that consumer body weight for each shoe size spans a huge spectrum. While a few manufacturers offer width options in shoe sizes, varying firmness of cushioning in a single model or shoe size is nonexistent in the marketplace.

SUMMARY OF THE INVENTION

The present invention is directed to a shoe that substantially obviates one or more of the needs or problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the system particularly pointed out in the written description and claims, as well as the appended drawings.

To achieve these and other advantages and in accordance with the purpose of the invention, as embodied and broadly described herein, the shoe includes an upper having a heel region and rear sole support attached to the heel region of the upper. The rear sole support includes a base, a first wall extending downwardly from the base and having a first groove, and a second downwardly extending wall opposite the first wall and having a second groove facing the first groove. A rear sole is detachably secured to the rear sole support with a mounting member attached to the rear sole and including at least one rim for engaging the first and second grooves. A locking member engages the rear sole support and one of the rear sole and mounting member to prevent rotation of the rear sole relative to the rear sole support during use.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Figure 1:
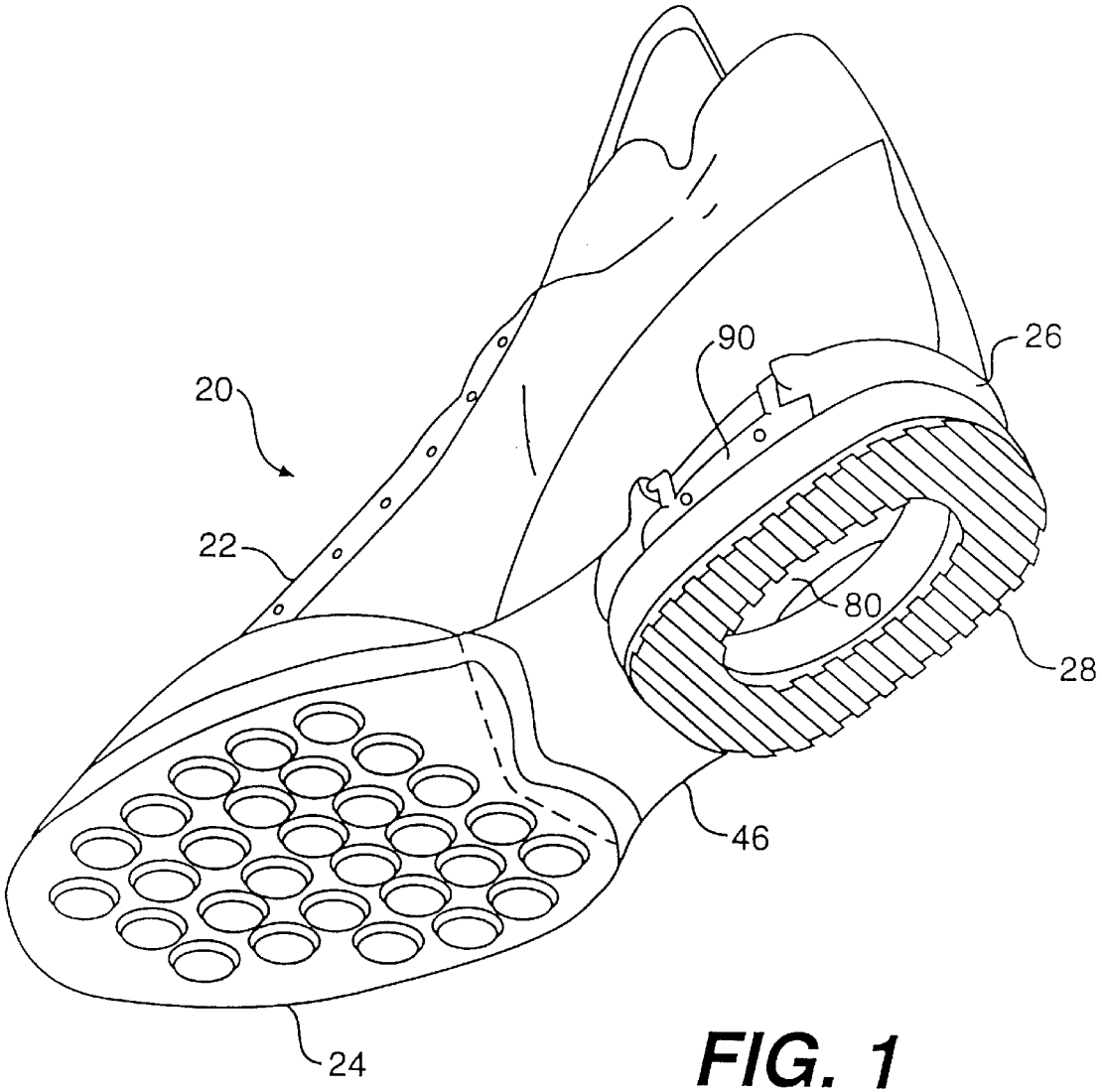
FIG. 1 is a perspective view of one embodiment of a shoe of the present invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates an embodiment of the shoe of the present invention. The shoe, designated generally as 20, is an athletic shoe principally designed for running, walking, basketball, tennis, and other forms of exercise.

As shown in FIG. 1, shoe 20 includes an upper 22, which is that portion of the shoe that covers the upper portion of the user's foot. The upper may be made of leather, a synthetic material, or any combination of materials well known in the art.

A forward sole 24 is attached to the forefoot region of the upper. The forward sole is a lightweight structure that provides cushioning to the forefoot region, and may include an abrasion-resistant rubber outsole laminated to a softer, elastomeric midsole layer. The forward sole is attached to the upper in a conventional manner, typically by injection molding, stitching or gluing.

In some conventional shoes, the forward sole (simply referred to in the industry as a "soles" would extend from the forefoot region to the rear edge of the heel. In other conventional models, portions of the outsole and/or midsole are reduced or eliminated in certain non-stress areas, such as the arch area, to reduce weight. However, in a radical departure from conventional shoes, the shoe of the present invention incorporates a heel structure, including a detachable rear sole, that significantly alleviates heel wear problems associated with conventional soles and provides enhanced cushioning and/or spring.

Figure 2:
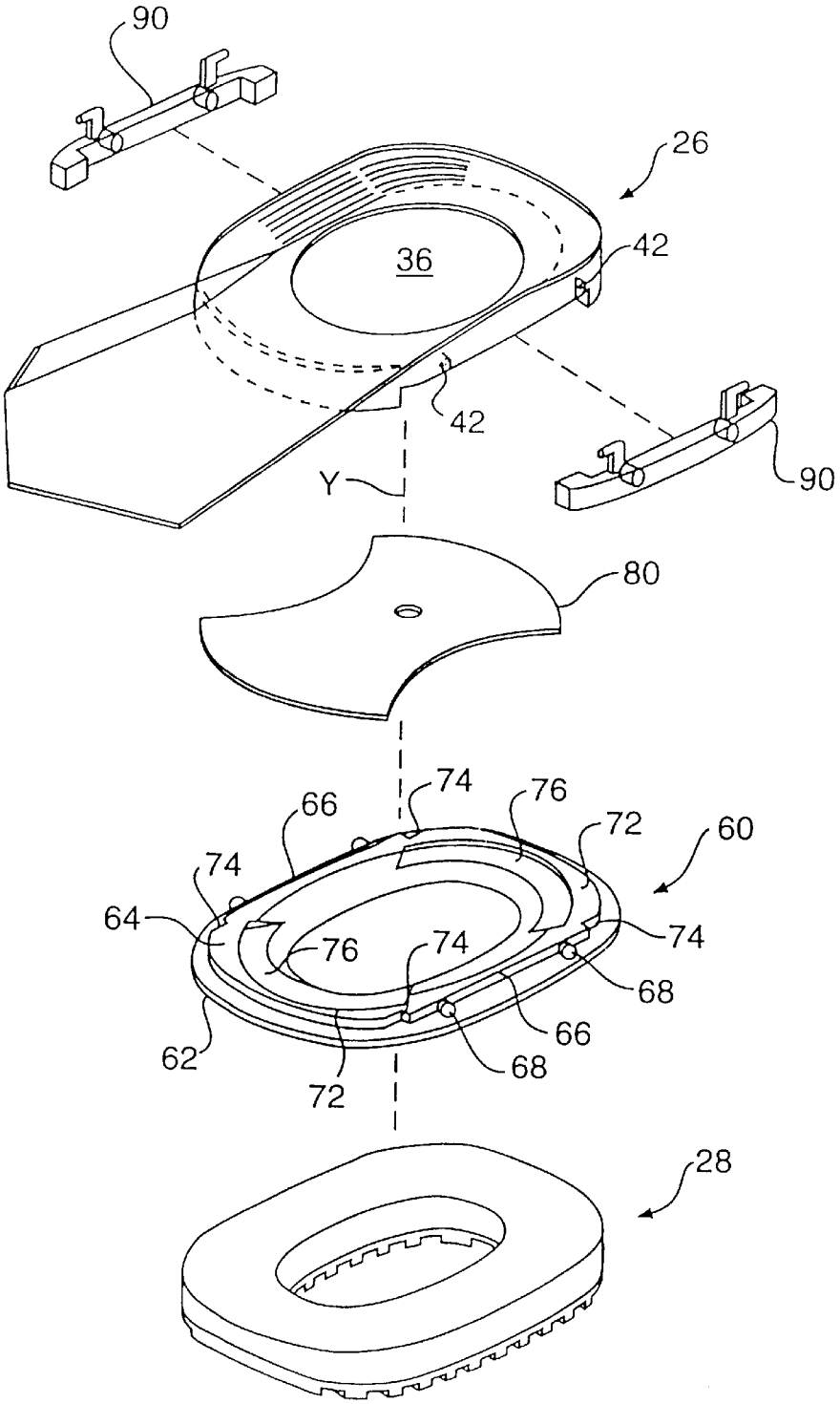
FIG. 2 is an exploded perspective view of the heel structure for the shoe shown in FIG. 1.

An embodiment of the heel structure is shown in FIGS. 1 and 2 and includes a rear sole support 26 attached to the heel region of the upper 22, a rear sole 28 detachably secured to the rear sole support 26, a mounting member 60 for detachably securing the rear sole 28 to the rear sole support 26, and locking members 90 for preventing rotation of the rear sole 28 relative to the rear sole support 26 during use. In addition, the heel structure may include a flexible plate 80 for providing spring to the heel of the user and reducing wear caused by midsole compression.

Figure 3:
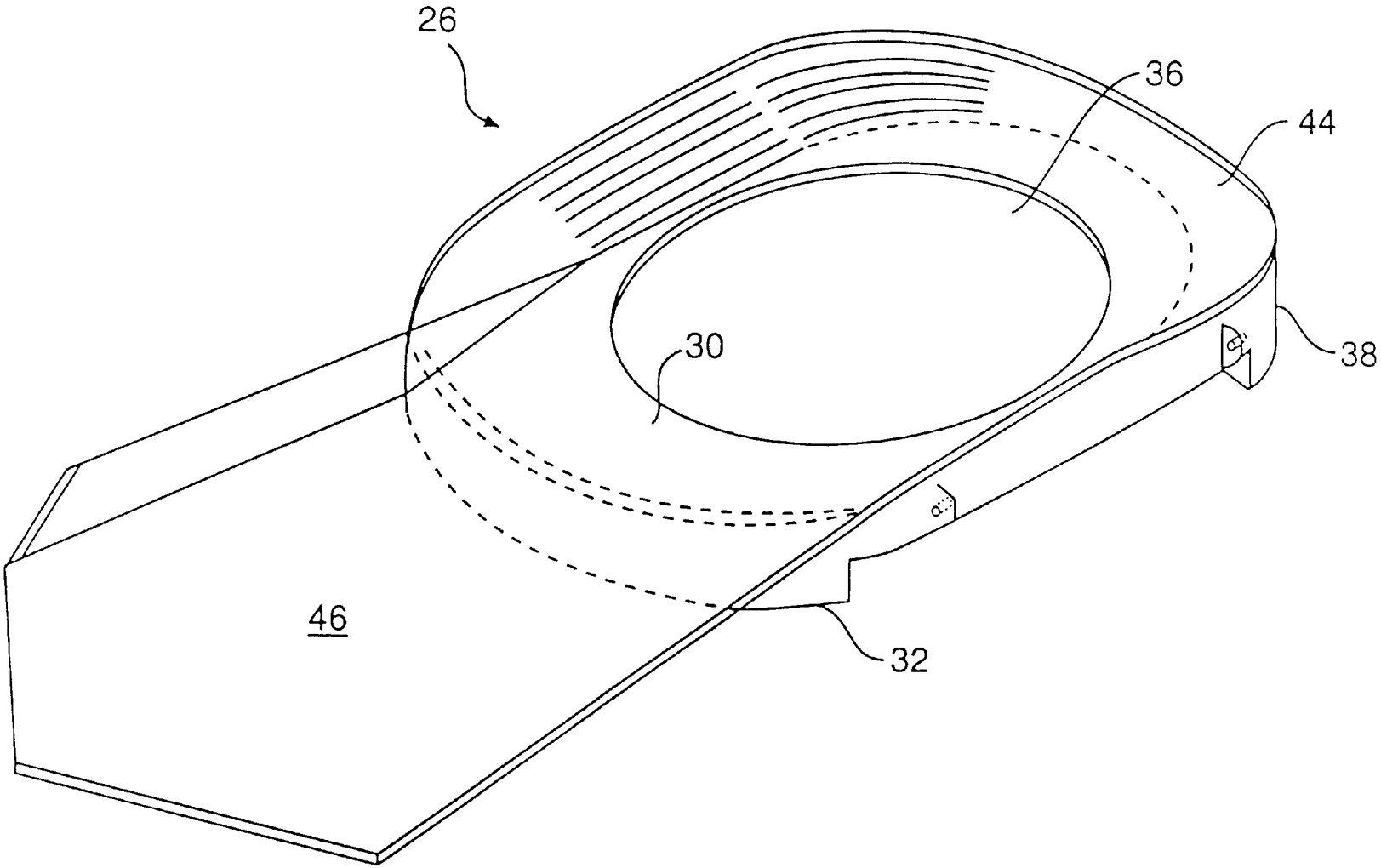
FIG. 3 is a perspective view of a rear sole support for the heel structure shown in FIG. 2.
Figure 4:
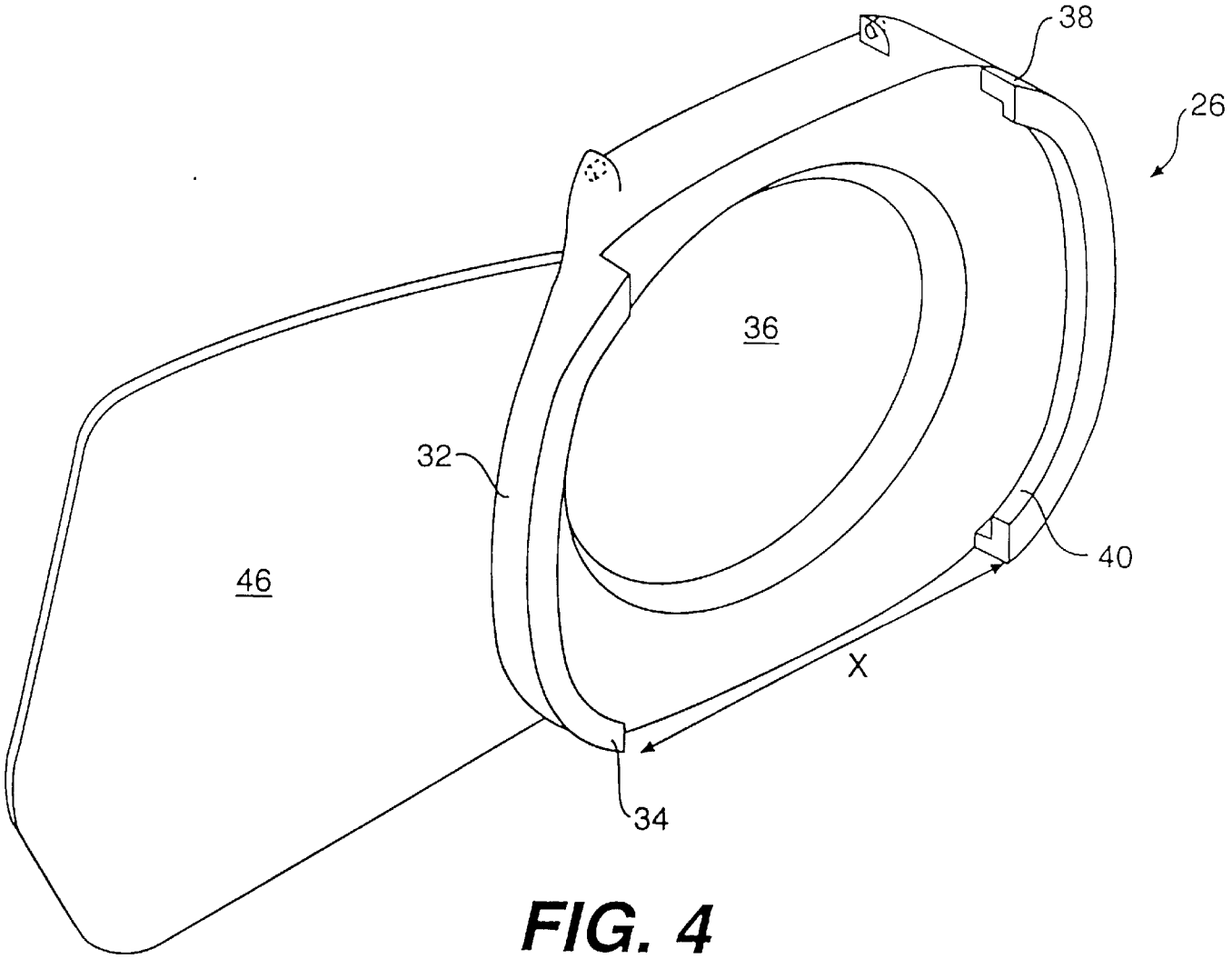
FIG. 4 is a perspective view showing the underside of the rear sole support shown in FIG. 3.

As shown in FIGS. 3 and 4, the rear sole support 26 includes a substantially oval or elliptically-shaped base 30, with somewhat flattened, medial and lateral sides, having a top surface that is attached to the upper by stitching, gluing, or other conventional means. The shape of such base is not limited, and could be circular, polygonal, or any variation of the foregoing. A front wall 32 extends downwardly from a front edge of the base 30, and a rear wall 38 extends downwardly from a rear edge of the base 30. Together, the front and rear walls define a recess that, as later described, receives means for detachably securing the rear sole to the rear sole support.

The front wall 32 includes a lip 34 turned toward the recess, with lip 34 and the recess side of wall 32 defining an arc-shaped front groove. The rear wall 38 includes a lip 40 turned toward the recess, with lip 40 and the recess side of wall 38 defining an arc-shaped rear groove otherwise substantially identical to and facing the front groove. The front and rear grooves have the same radius of curvature and together may constitute arcs of a common circle. At least one, and preferably both, of the front and rear grooves disclosed in FIG. 4 (and all drawings that disclose front and rear grooves), define a circular arc that is less than 180°. As shown in all of such drawings, both of such circular arcs also may substantially traverse the rear sole support 26 from its lateral to its medial side. The front and rear grooves may also be shaped to define arcs of a common circle having a diameter greater than the width of the rear sole support 26 or mounting member 60 or rear sole 28 or even the heel region of the upper 22. The front and rear walls may be flush with the outer edge of base 30 and are spaced from each other on the medial and lateral sides of the base by a distance X, as shown in FIG. 4, which may be slightly greater than the width of the rear sole support 26 or mounting member 60 or rear sole 28.

The rear sole support also has a central opening 36 directly below the heel region of the upper. This central opening, which may be circular, oval, or virtually any polygonal shape, allows the heel of the user to be cushioned by the rear sole attached to the rear sole support or by the flexible plate 80, instead of the firm material comprising the rear sole support.

The rear sole support may be composed of hard plastic, such as a durable plastic manufactured under the name PEBAX™, graphite, a graphite composite, or other material having sufficient rigidity and strength to securely engage the rear sole attaching mechanism (discussed below). Injection molding or other conventional techniques may be used to form the rear sole support.

The rear sole support 26 may also include a heel counter 44, as shown in FIG. 3, for providing lateral stabilization to the user's heel. The heel counter extends upwardly from the edge of the base 30 in a contoured fashion and is preferably made of the same material as, and integral with, the rear sole support through injection molding or other conventional techniques.

As shown in FIGS. 1–4, an arch bridge 46 may generally extend from the base 30 of the rear sole support to the forward sole for supporting the arch region of the foot. The arch bridge 46 is an optional feature composed of a firm, lightweight material. The arch bridge 46 is attached to the upper 22 and forward sole 24 by gluing or other conventional methods. The arch bridge 46 also may be composed of the same material as the rear sole support or a more flexible material and may be made integral with the rear sole support. Such one-piece construction of the arch bridge together with the rear sole support solves a major problem, and that is the tendency of an athletic shoe of conventional "full body" arch construction to curl or twist at the juncture of the hard rear sole support and the resilient forward sole. It also reduces the weight of the shoe by reducing or eliminating the midsole material, e.g., polyurethane or EVA, that would normally occupy the arch area of the shoe The rear sole support, heel counter, and arch bridge need not be made of a solid material. Holes or spaces may be created, at the time of manufacture, throughout the structure to decrease weight without diminishing strength.

Figure 5:
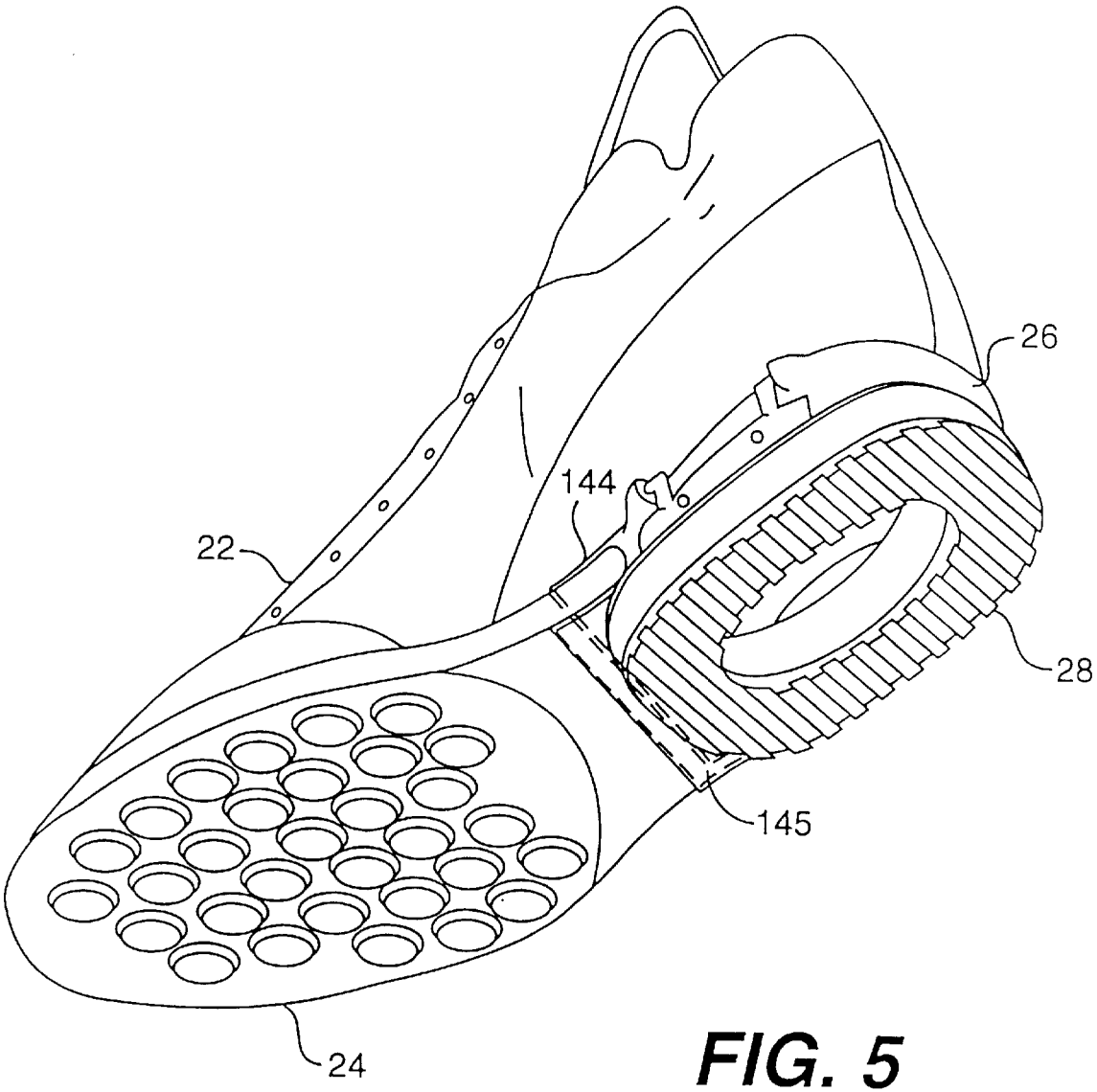
FIG. 5 is a perspective view of another embodiment of the shoe of the present invention.
Figure 6:
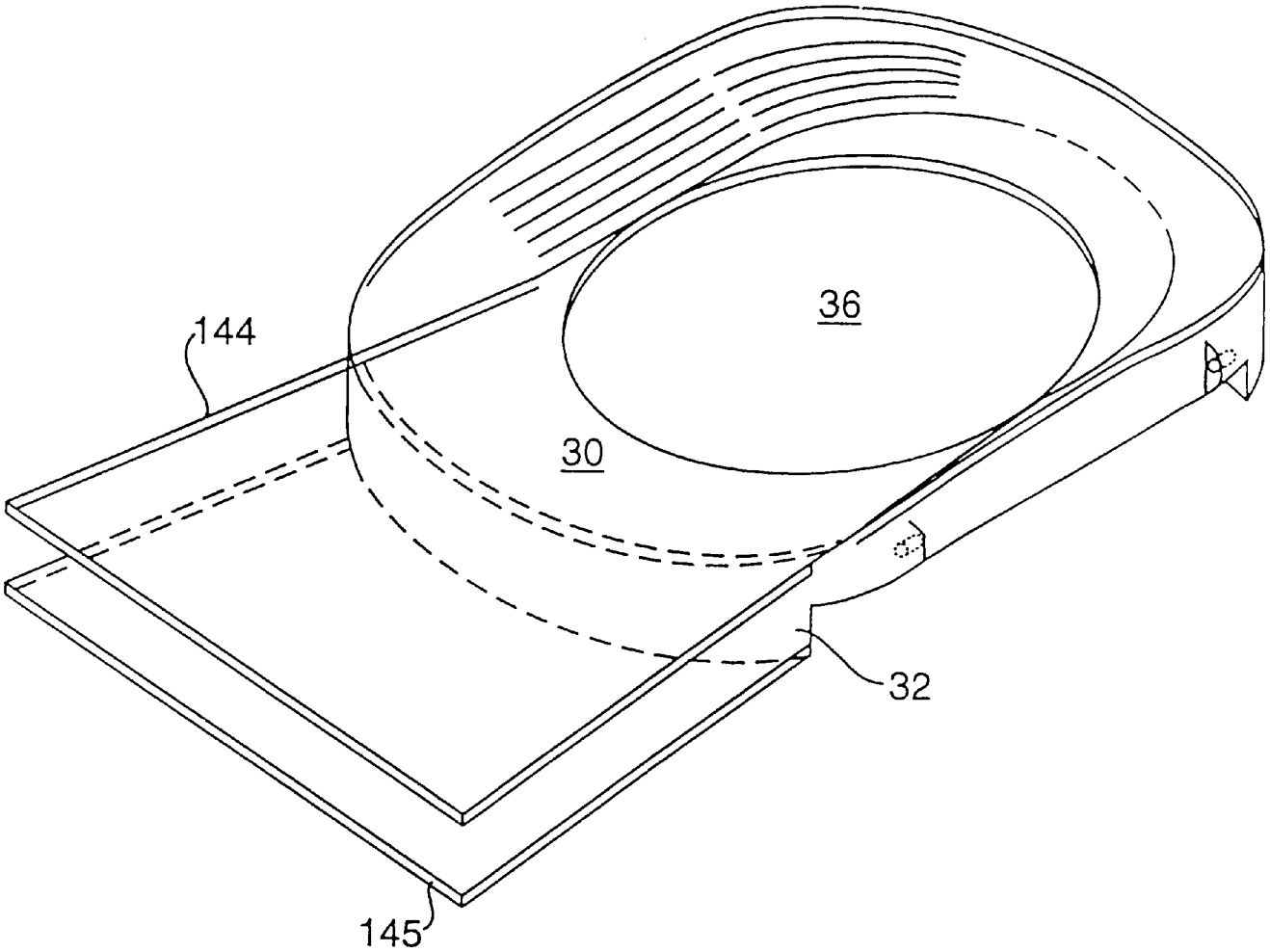
FIG. 6 is a perspective view of a rear sole support for the shoe shown in FIG. 5.
Figure 7:
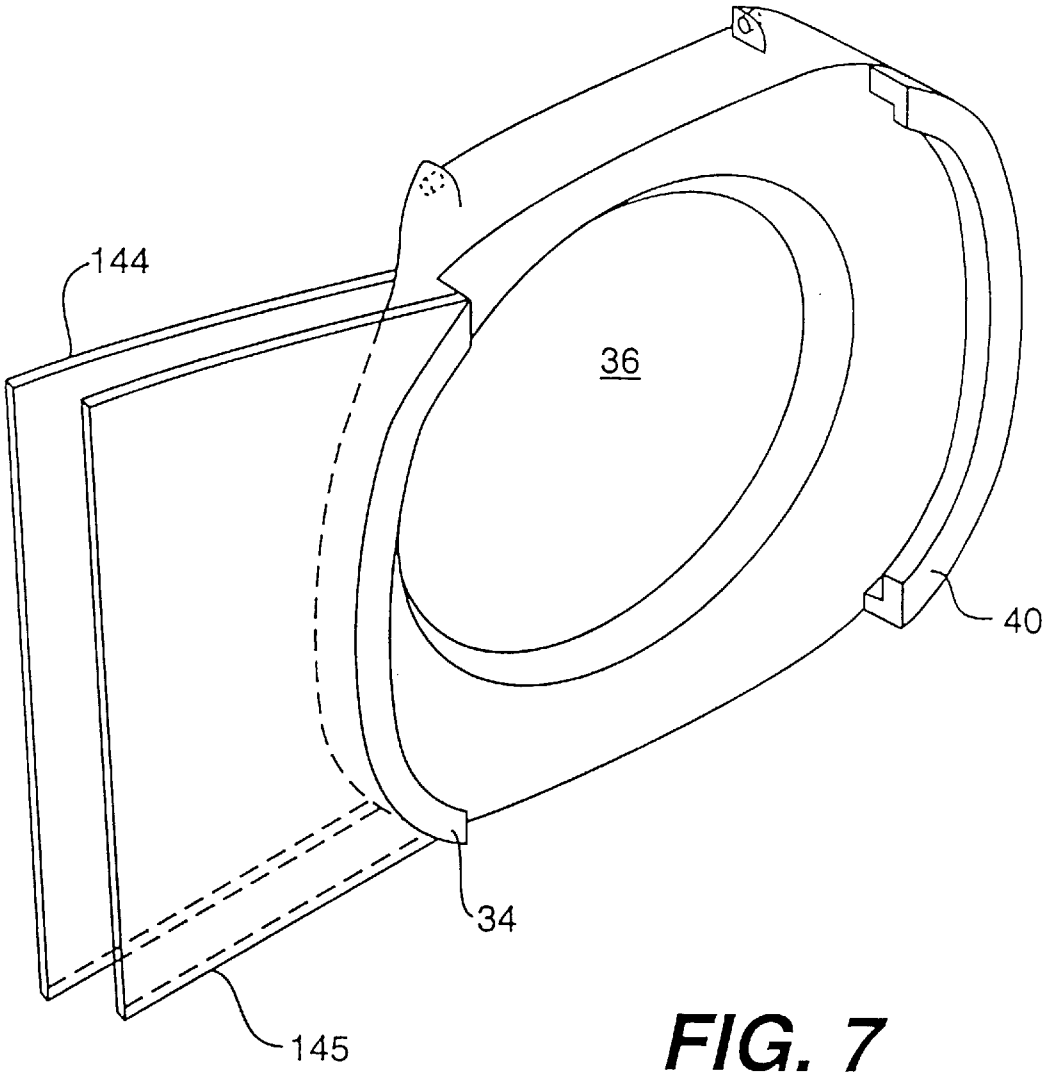
FIG. 7 is a perspective view showing the underside of the rear sole support shown in FIG. 6.

As an alternative to the arch bridge 46, the rear sole support 26 in all of the embodiments may include upper and lower horizontal walls 144 and 145, as shown in FIGS. 5–7, extending from, and preferably integrated with, front wall 32. In this embodiment, the forward sole 24 extends into the arch region and is sandwiched between upper and lower walls 144 and 145 and against front wall 32. It may then be further secured by gluing. As a further alternative, the rear portion of the forward sole may simply extend to the rear sole support, without upper and lower walls 144 and 145, and be glued to the front wall 32. Alternatively, the rear sole support 26 could have one wall like either 144 or 145 extending from and preferably integrated with it, but not both walls; or posts, rods, or other members, substantially parallel to the ground, could be substituted for walls and may extend from and be integrated with front wall 32 into or along the surface of the midsole or outsole material in the forward sole and then secured by gluing. Other means may be employed as an alternative to the arch bridge 46. An advantage to combining the rear sole support with walls 144 and/or 145, or eliminating both of such walls entirely, and all other alternatives to the integral arch bridge, is that such options, unlike the integral arch bridge, permit manufacture of only one rear sole support suitable for either the left or right shoe, thus decreasing manufacturing costs.

Figure 8:
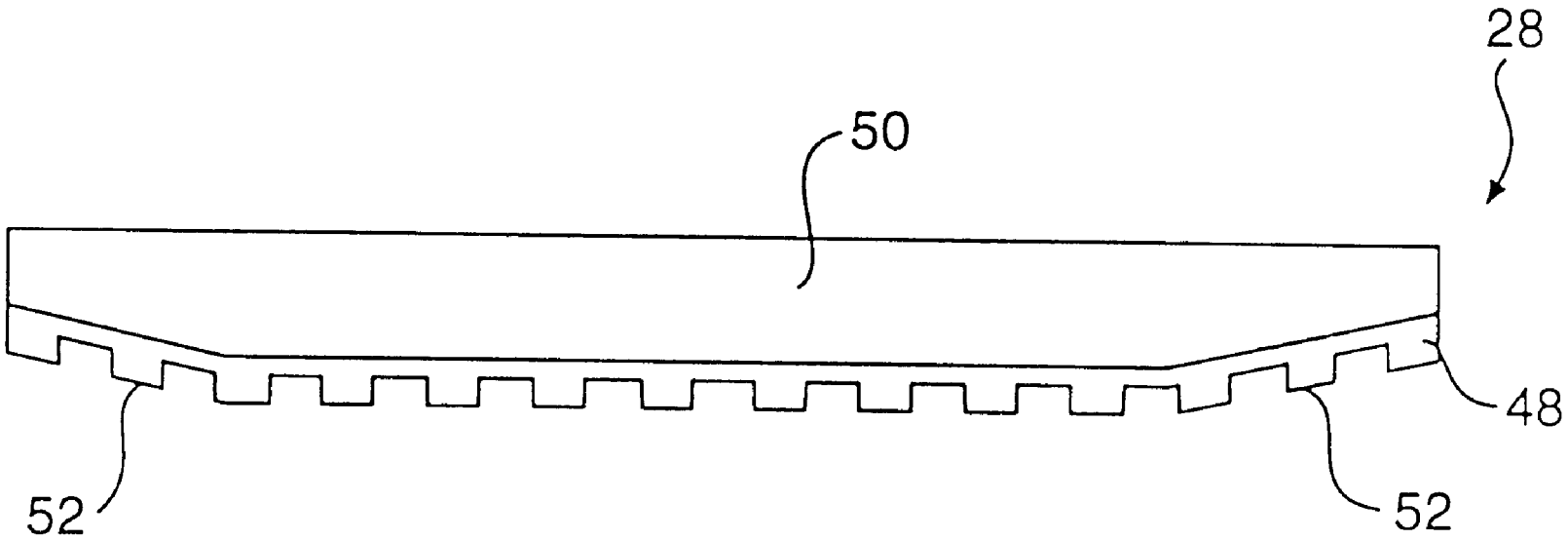
FIG. 8 is a side view of a rear sole for the heel structure shown in FIG. 2.
Figure 9:
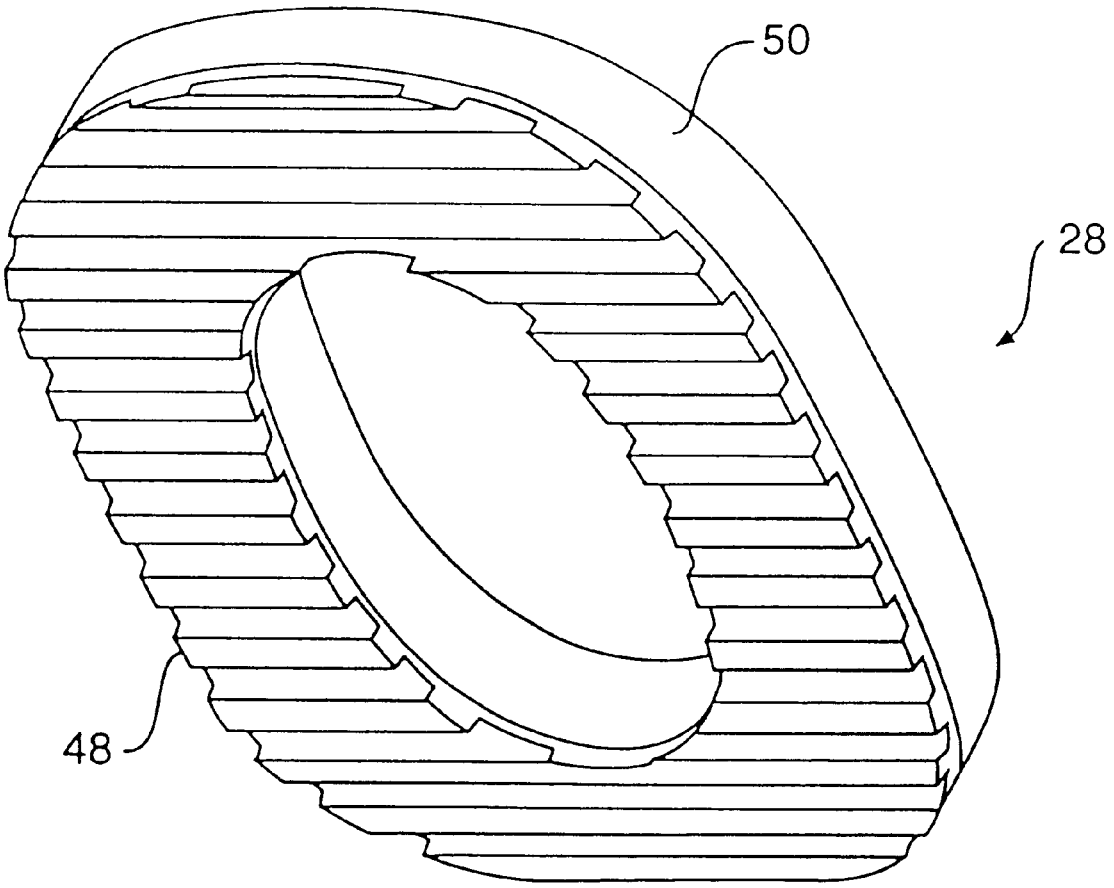
FIG. 9 is a perspective view showing the underside of the rear sole shown in FIG. 8.

The heel structure shown in FIG. 2 also includes a rear sole 28 detachably secured to the rear sole support. As shown in FIGS. 8 and 9, rear sole 28 may include a ground-engaging outsole 48 laminated to a midsole 50, which may be more resilient than the outsole, with both the outsole and midsole being more resilient than the rear sole support. The outsole, which may be composed of a rubber compound, provides abrasion resistance and some cushioning, while the midsole, which may be composed of a more resilient, elastomeric material such as polyurethane, ethylene vinyl acetate (EVA), HYTREL™ (made by E.I. DuPont de Nemours & Co.), or other materials well known in the art, primarily provides cushioning to the heel during heel strike. Optionally, the rear sole could be comprised of a single homogenous material, or any number of layers or combinations of materials, including a material comprising air encapsulating tubes disclosed, for example, in U.S. Pat. No. 5,005,300.

Figure 10A:
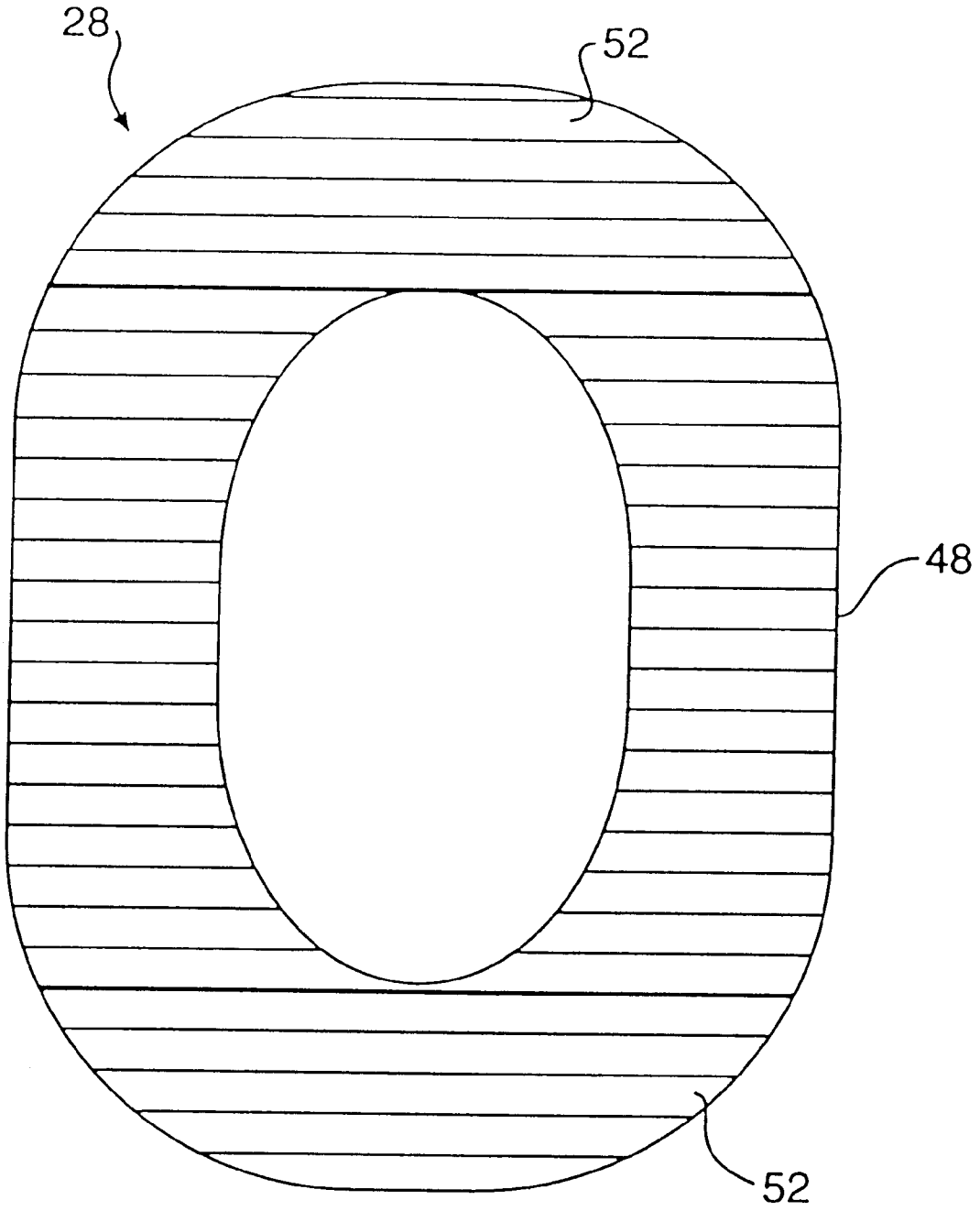
FIGS. 10A–C are bottom views showing alternative ground-engaging surfaces for the rear sole shown in FIG. 8.
Figure 10B:
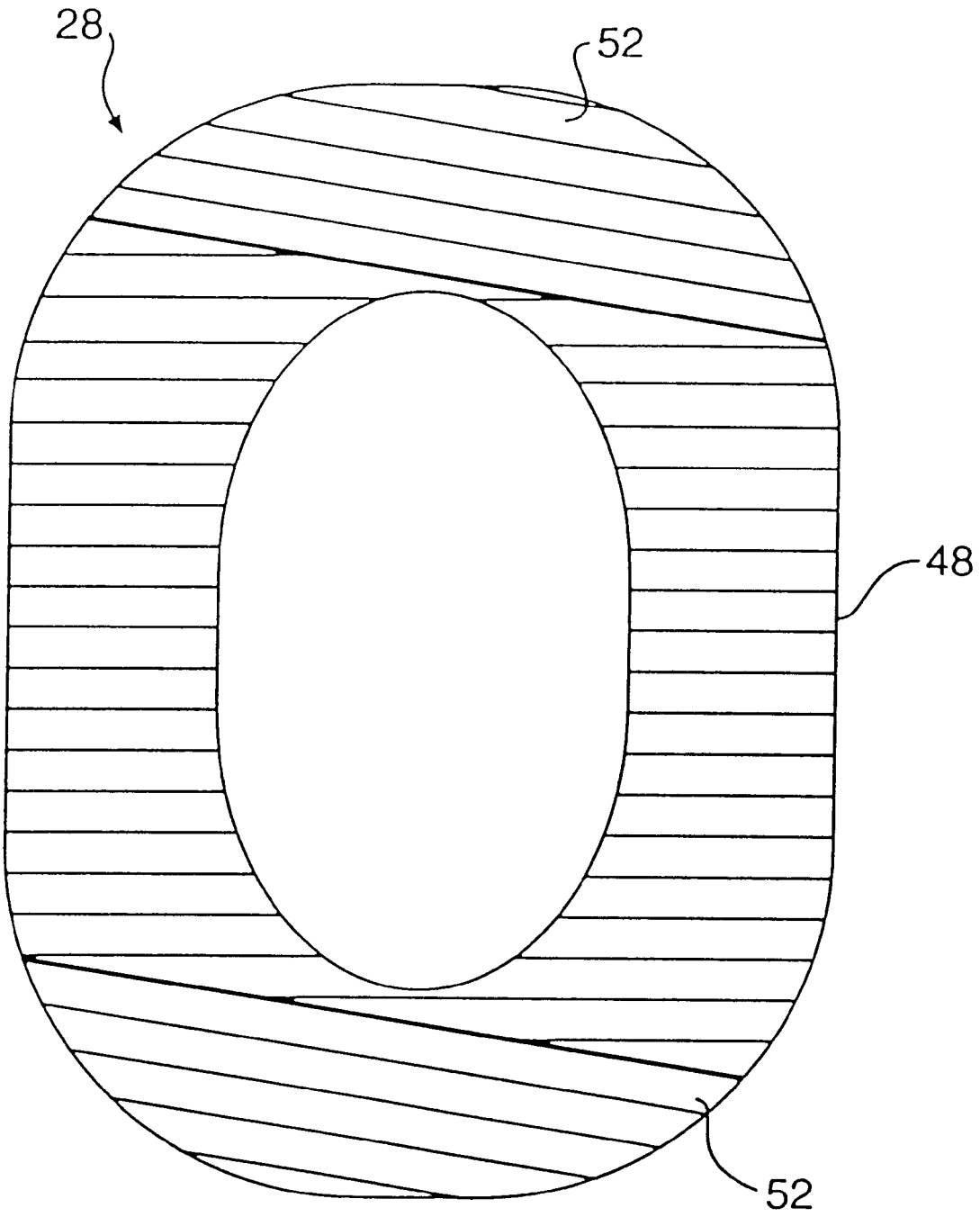
Figure 10C:
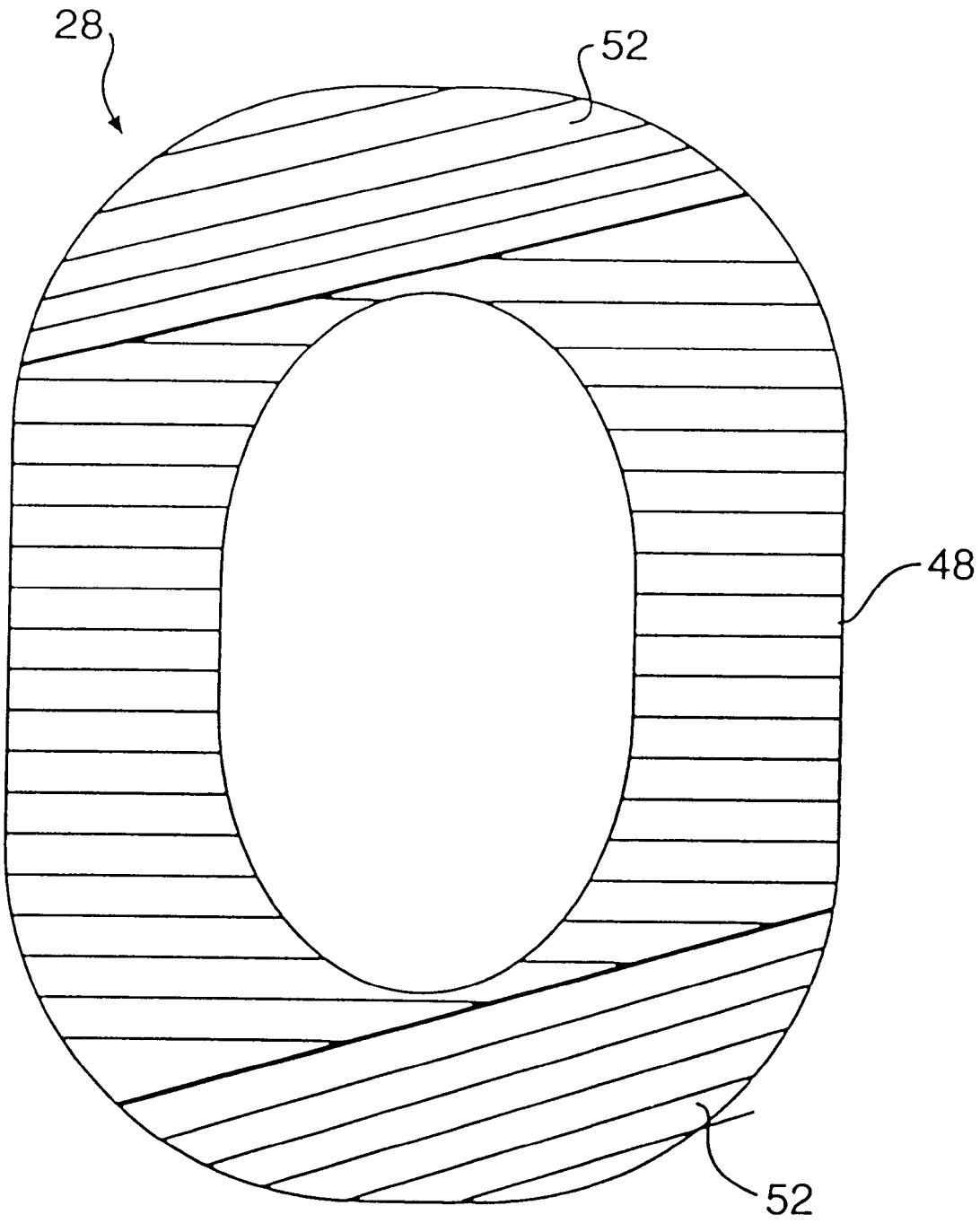

The outsole 48 may be planar or non-planar. Preferably, the outsole, particularly on running shoe models, includes one or more tapered or beveled segments 52, as shown in FIG. 8, which when located at the rear of the shoe will soften and/or align heel strike during the gait cycle. The beveled segments 52 may be located at the front and rear portions of the rear sole, as shown in FIG. 10A, slightly offset from the front and rear portions, as shown in FIGS. 10B and 10C, or at any other location, depending on the preference of the user or any heel strike or wear pattern. The beveled segments 52 may also be aligned on a "special order" basis to deal with particular pronation or supination characteristics of the user.

As shown in FIG. 9, rear sole 28 is elliptical or oval in shape, with somewhat flattened medial and lateral sides, with its length along the major axis of the shoe (when attached to the rear sole support and ready for use) being greater than its lateral width. As a result, the rear sole has a greater ground-engaging surface than if it were circular or equilaterally polygonal. Such increased ground-engaging surface provides greater stability, particularly if multiple or large beveled segments are used. However, the shape of the rear sole 28 may also be circular, polygonal, or otherwise. Rear sole 28 may or may not feature a hole in its center as shown in FIG. 9, and preferably should not exist if flexible plate 80 (later discussed) is not used.

Figure 11:
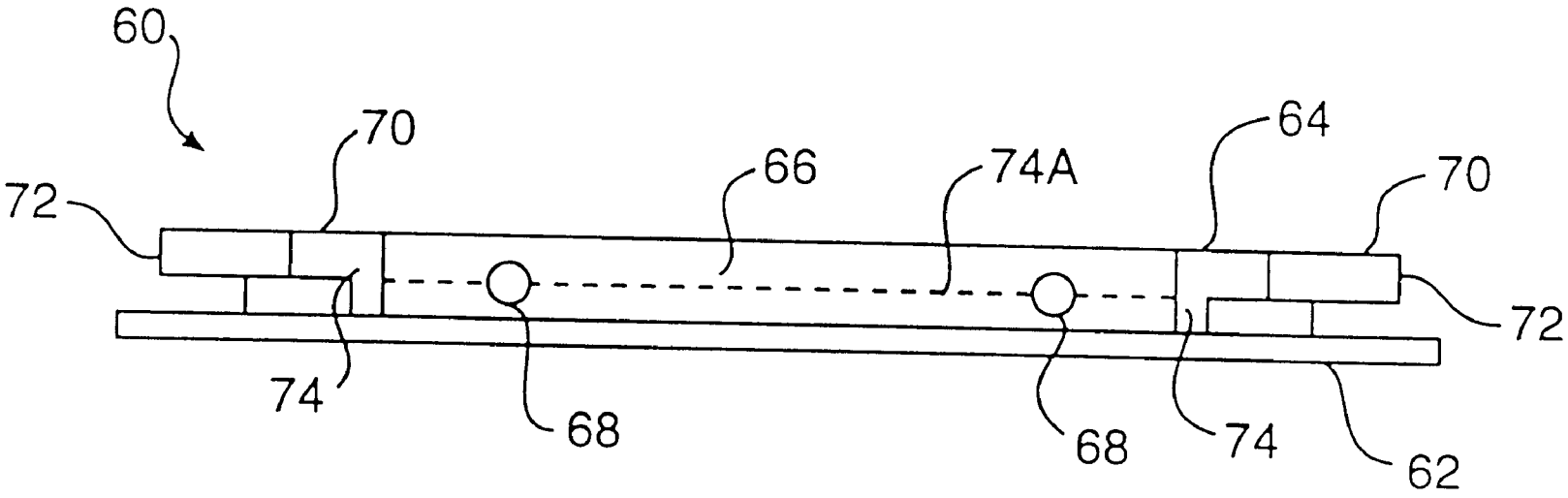
FIG. 11 is a side view of a mounting member for the heel structure shown in FIG. 2.

Rear sole 28 is detachably secured to the rear sole support 26 with a mounting member 60. As shown in FIGS. 2 and 11, mounting member 60 has a base layer 62 that is affixed to the top surface of the rear sole 28 with adhesive or other conventional means that will not degrade the cushioning/spring properties of the rear sole. There is an engaging layer 64 above base layer 62 and notch layer 74A. Lateral sides 66 each contain protrusions 68 with bulbous ends. Front and rear ends 70 of the engaging layer 64 include circular arc-shaped rims 72 having substantially the same radius of curvature as the front and rear grooves of the rear sole support and engage the front and rear grooves of the rear sole support.

To attach the rear sole to the rear sole support, the rear sole, with the mounting member 60 attached (and, optionally, with a flexible plate 80, discussed later, supported on the mounting member 60), is positioned relative to the rear sole support so that the front and rear rims of the mounting member are rotated in a circular manner no more than about 90°, about axis Y from their positions shown in FIG. 2. The mounting member is centered between the front and rear grooves, then pressed against the bottom of the base 30 and rotated less than 180°, and generally no more than about 90° (clockwise or counterclockwise), so that rims 72 fully engage the front and rear grooves of the rear sole support defined by lips 34 and 40 seen in FIG. 4. When the rear portion of the rear sole becomes worn, the rear sole can be rotated in a circular manner 180° so that the worn rear portion now faces toward the front of the shoe and occupies an area somewhat forward of the calcaneus where little or no weight of the user is applied. When the rotated rear portion of the rear sole also becomes worn, the rear sole may be detached and exchanged with the rear sole of the other shoe, since wear patterns of left and right heels are typically opposite. The rear sole may also be discarded and replaced with a new one with or without any rotation or exchange between left and right shoe.

The mounting member 60 may be made of any number of hard, lightweight materials that provide sufficient strength and rigidity to firmly engage the rear sole support, and support the flexible plate 80 if used. Examples of such materials include: hard plastic; PEBAX™; HYTREL™ in its hard format; graphite; and graphite, graphite/fiberglass, and fiberglass composites. Hardness of the mounting member may in fact be especially important if flexible plate 80 is used, because the peripheral edges of such plate need to press against a firm foundation if the central portion of such plate is to properly deflect under the weight of the user's foot and impart spring to the user's gait cycle. In any event, the mounting plate material is generally stiffer than the materials used for the rear sole midsole and outsole.

Base layer 62 may be entirely eliminated from the mounting member 60 shown in FIG. 2, in which case the periphery of the top surface of rear sole 28 presses tightly against lips 34 and 40 of the rear sole support when engaged.

Figure 12:
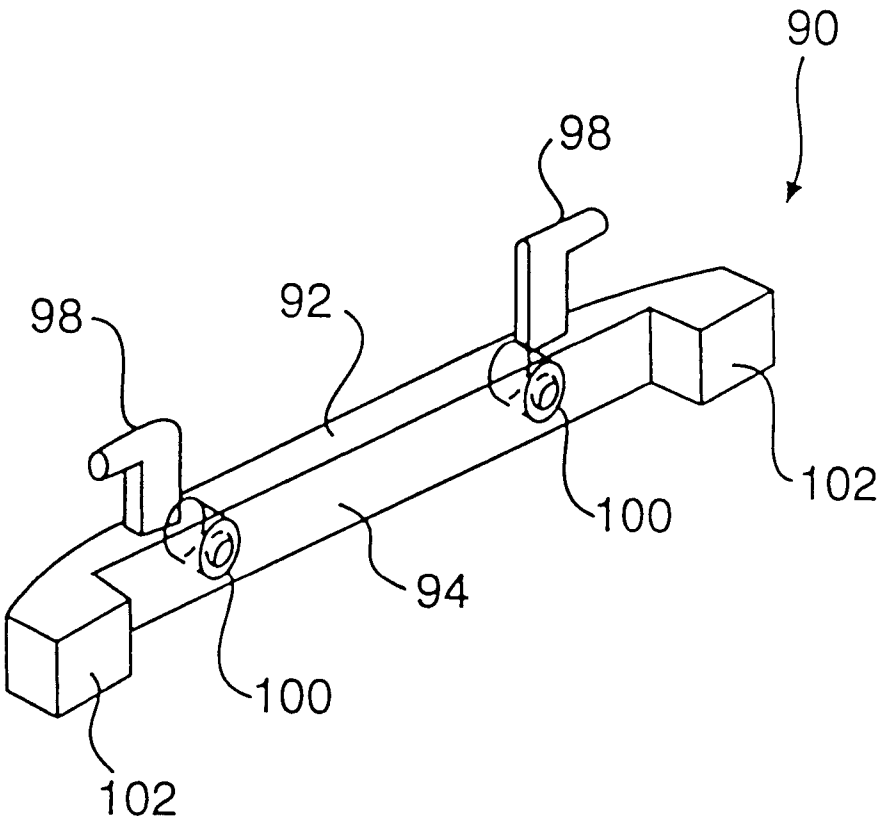
FIG. 12 is a perspective view of a locking member for the heel structure shown in FIG. 2.
Figure 13:
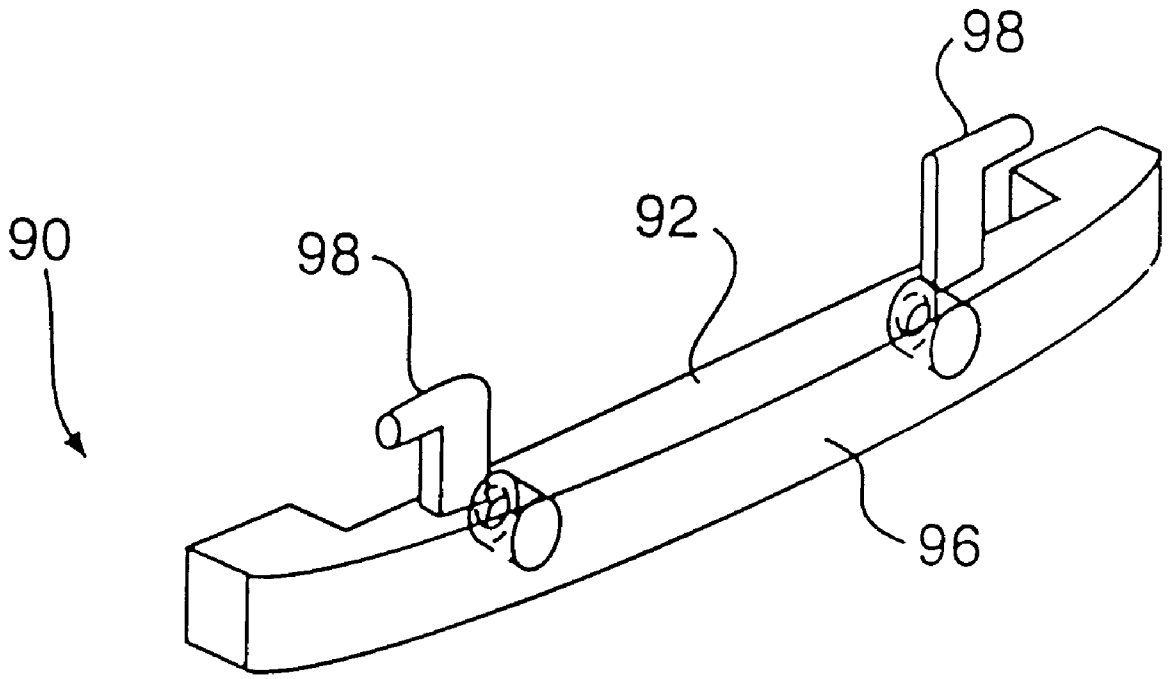
FIG. 13 is a perspective view showing the opposite side of the locking member shown in FIG. 12.

To prevent the rear sole from rotating relative to the rear sole support once engaged with each other, locking members 90 lock the mounting member to the rear sole support at the appropriate orientation. As shown in FIGS. 12 and 13, locking member 90 includes a base 92 with a substantially planar inner surface 94 and an outer surface 96 contoured according to the sides of the rear sole support when attached thereto. A pair of L-shaped arms 98 extend from the base 92 (preferably from its top, e.g., from the external surface of the heel counter) and engage opposed openings 42 (FIG. 2) in the rear sole support to pivotally attach the locking member 90 to the rear sole support. Openings 42 may also be formed in the heel region of the upper. When attached to the rear sole support, the locking members occupy the spaces (having a length X as shown in FIG. 4) between the front and rear walls of the rear sole support, as shown in FIG. 1.

Apertures 100 are formed in the base 92 for receiving the protrusions 68 of mounting member 60. The apertures have a small opening adjacent surface 94, then expand in diameter within the base to a larger opening near surface 96 to accommodate the bulbous ends of the protrusions 68. As a result, the protrusions "snap" into the apertures 100 to lock the locking members in position. In addition, projections 102 extend inwardly from opposite ends of base 92 and engage notches 74 in the mounting member between the front and rear ends and the lateral sides (FIGS. 2 and 11) to prevent rotation of the rear sole when the locking members are in the position shown in FIG. 1.

As shown in FIG. 2, mounting member 60 includes slots 76 for supporting a flexible plate 80 between the rear sole and the heel portion of the upper so that a portion of plate 80 is exposed through central opening 36. The flexible plate, which may be made of a graphite composite or other stiff, but flexible, material, reduces heel-center midsole compression and provides spring to the user. The flexible plate is, of course, stiffer than the materials used for the outsole or midsole, but must be sufficiently flexible so as to not detrimentally affect cushioning of the user's heel. A graphite or graphite/fiberglass composite, including carbon or carbon and graphite fibers woven in an acrylic or resin base, such as those manufactured by Biomechanical Composites Co. of Camarillo, Calif., may be used.

Figure 14B:
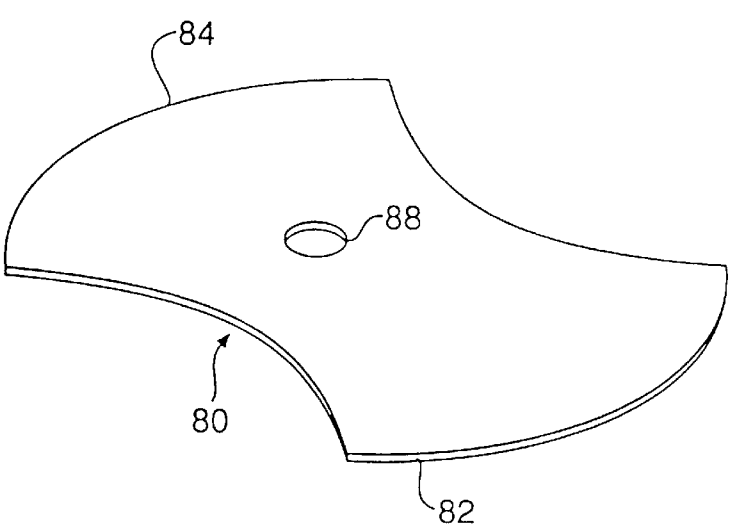
FIGS. 14A–C are top, perspective, and side views, respectively, of a flexible plate for the heel structure shown in FIG. 2.
Figure 14A:
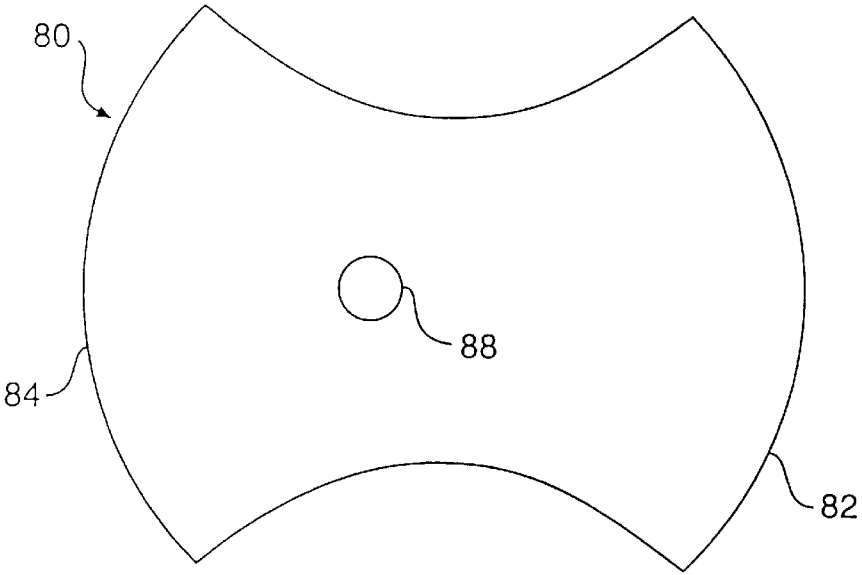
Figure 14C:
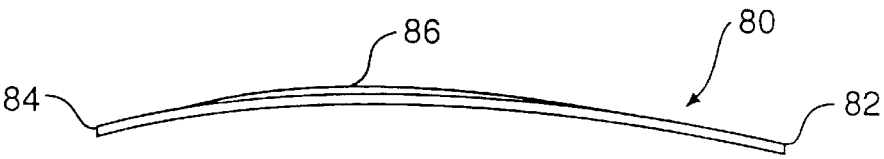

As shown in FIGS. 14A–C, flexible plate 80 includes front and rear edges 82 and 84 that are supported by slots 76 (see FIG. 2) in the mounting member. The flexible plate may have a substantially convex upper surface that curves upwardly between the front and rear edges to an apex 86, which is preferably located below the calcaneus of the user when the rear sole is attached to the rear sole support. An aperture 88 may be provided at the apex 86 to increase spring.

Figure 15B:
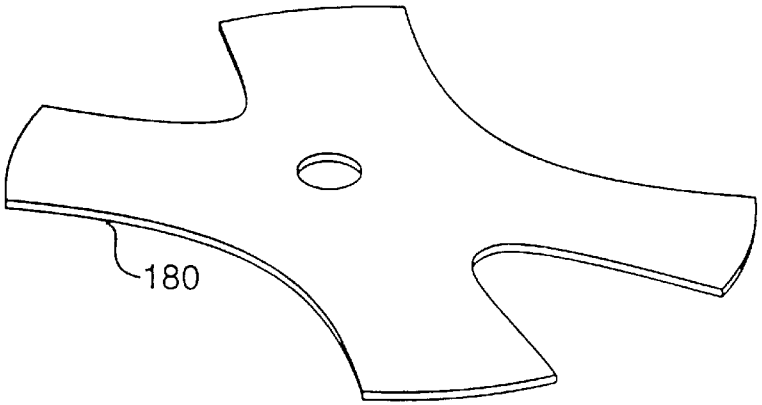
FIGS. 15A–C are top, perspective, and side views, respectively, of another embodiment of a flexible plate for use in the heel structure shown in FIG. 2.
Figure 15A:
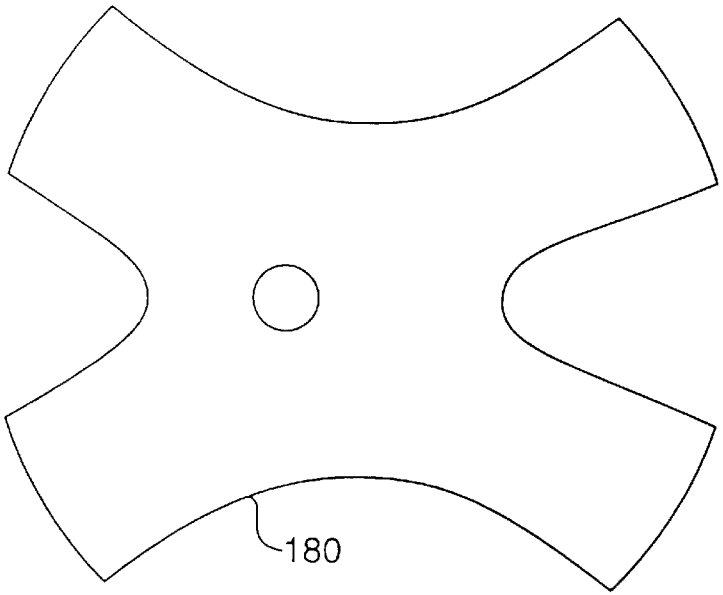
Figure 15C:
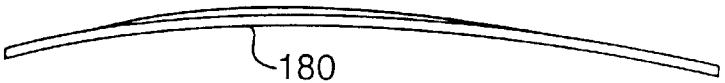
Figure 16A:
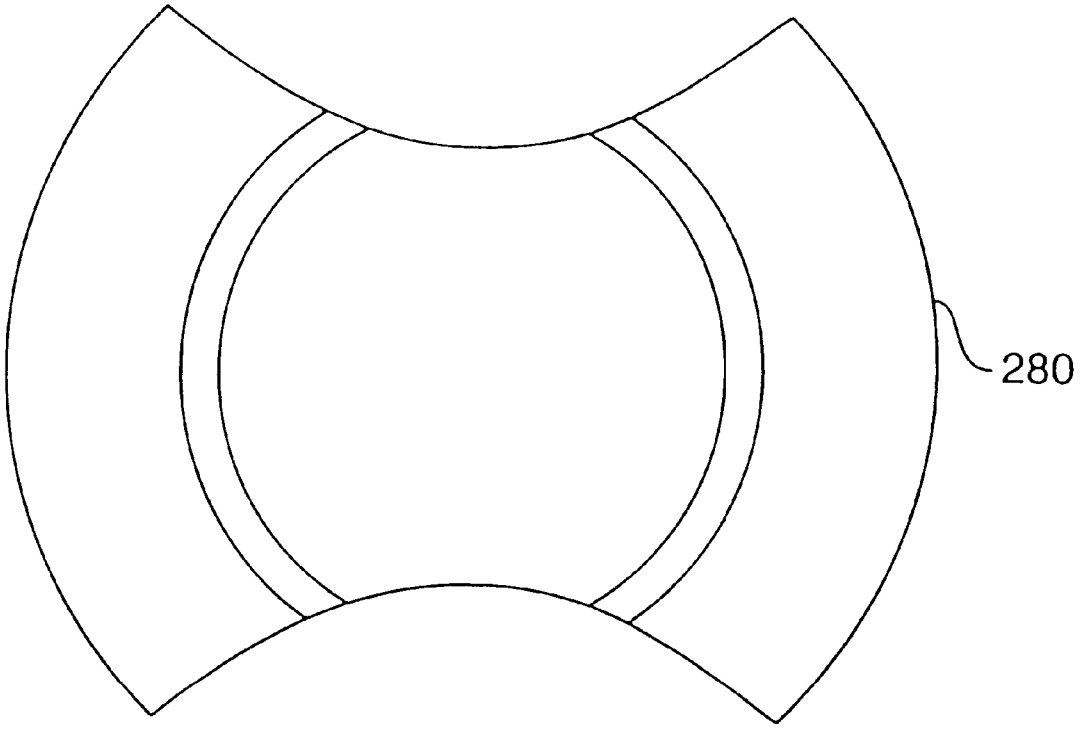
FIGS. 16A and 16B are top and side views, respectively, of another embodiment of the flexible plate for use in the heel structure shown in FIG. 2.
Figure 16B:
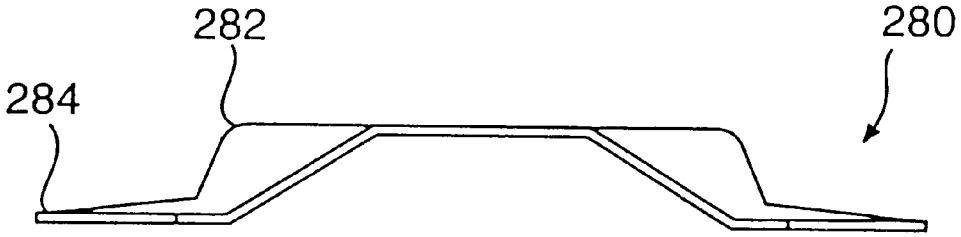

The plate may also be flat or concave, and may be substantially hour glass-shaped, as shown in FIGS. 14A–C, or H-shaped, as is the plate 180 shown in FIGS. 15A–C. Other shapes are also contemplated as long as such shapes provide spring and reduce midsole compression of the rear sole. For example, FIGS. 16A and B show another hour glass-shaped flexible plate 280 with discrete upper and lower sections 282 and 284.

When the flexible plate is used, the rear sole may be devoid of material in its center, as shown in FIG. 2, to reduce the weight of the rear sole. If the center is devoid of material, a thin horizontal membrane (not shown), with or without a flanged edge, composed of plastic or other suitable material may be inserted into the void and attached to the walls of the void, by compression fit or otherwise, to seal the void and prevent moisture or debris from entering or collecting therein.

Apex 86 is located, in FIGS. 14C and 15C, slightly to the rear of the center of the major axis of plate 80, so as to be positioned more directly beneath the center of the calcaneus. Thus, it will be necessary to remove and rotate plate 80 by 180° on an axis perpendicular to the major axis of the shoe when the rear sole is rotated, in order to keep the apex positioned directly beneath the calcaneus. However, plate 80 may be formed with the apex in any position to suit a user's preference. It many even be placed in the exact center of plate 80 so as to obviate the need for plate rotation when the rear sole is rotated.

Flexible plate 80 provides spring to the user's gait cycle in the following manner. During heel strike in the gait cycle, the user's heel provides a downward force against the plate. Since the peripheral edges of the plate are firmly supported by the mounting member, the interior portion of the plate deflects downwardly relative to the peripheral edges. As the force is lessened (with the user's weight being transferred to the other foot), the deflected portion of the plate, due to its elastic characteristics, will return to its original shape, thereby providing an upward spring force to the user's heel. Such spring effect will also occur whenever a force is otherwise applied to and then removed from the flexible plate (e.g., jumping off one foot, or jumping from both feet simultaneously).

The removability of the flexible plate allows the use of several different types of flexible plates of varying stiffness or composition. Thus, flexible plate designs and characteristics can be adapted according to the weight of the user, the ability of the user, the type of exercise or use involved, or the amount of spring desired in the heel of the shoe. Removability also permits easy replacement of the plate should deterioration occur, a concern in the case of virtually any truly spring-enhancing plate material.

The heel structure embodiment shown in FIG. 2 is but one of many embodiments contemplated by the present invention. While further embodiments are discussed below, additional embodiments are possible and within the scope of the invention. Unless otherwise noted, the structure, material composition, and characteristics of the heel components shown in FIGS. 1 and 2 apply to all of the embodiments.

Figure 17:
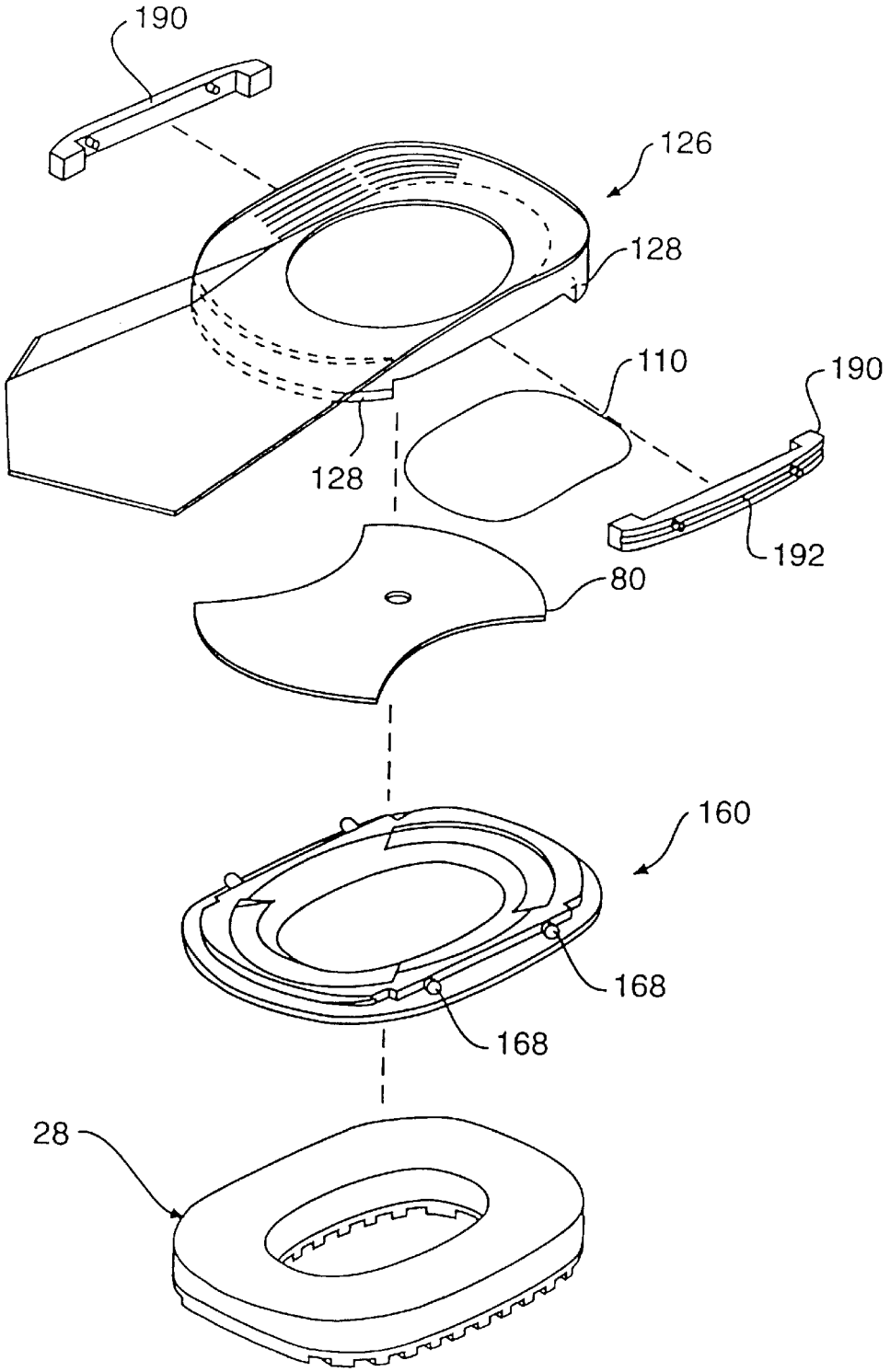
FIG. 17 is an exploded perspective view of another embodiment of the heel structure of the present invention.
Figure 18:
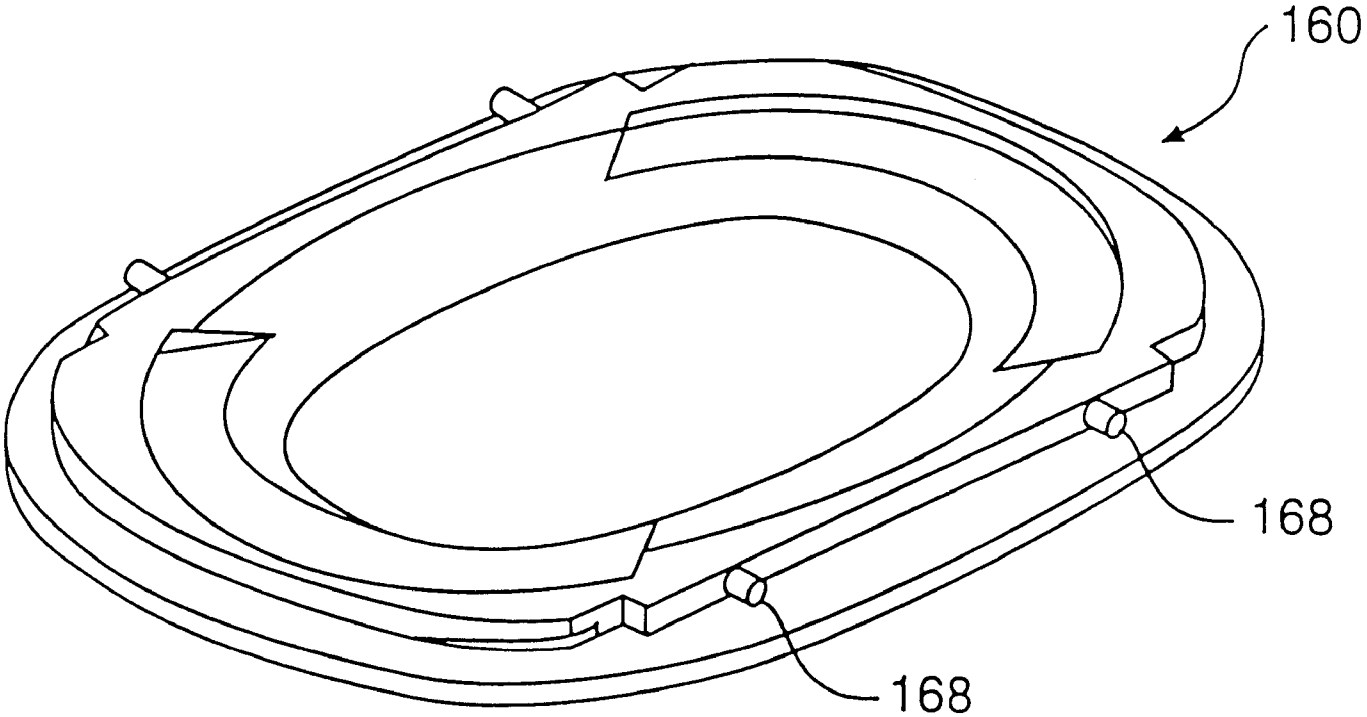
FIG. 18 is a perspective view of a mounting member for the heel structure shown in FIG. 17.
Figure 19A:
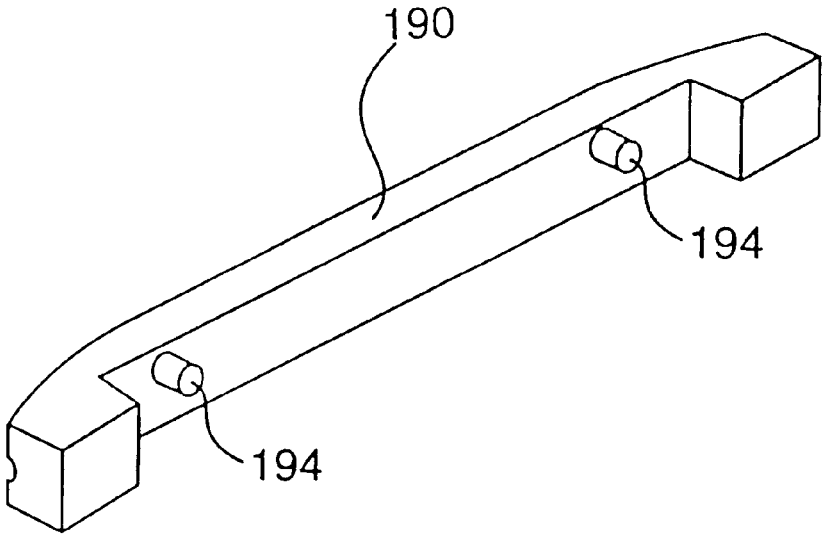
FIGS. 19A and 19B are perspective views of a locking member for the heel structure shown in FIG. 17.
Figure 19B:
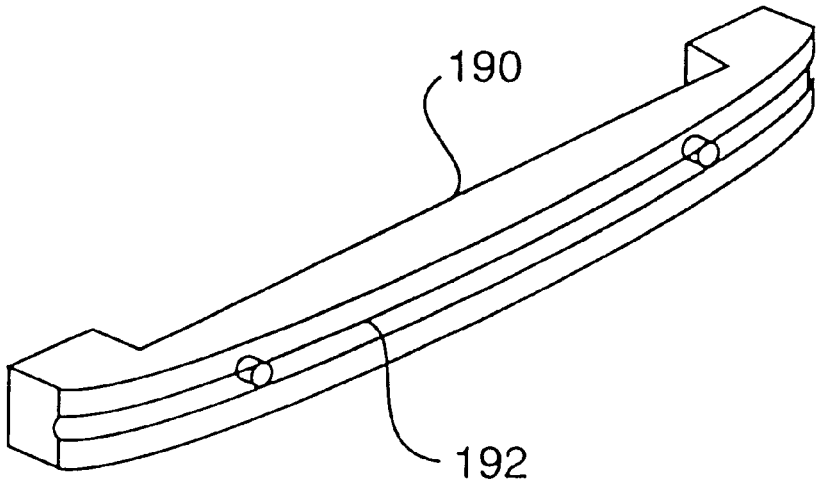

One such embodiment is shown in FIGS. 17–19B. In this embodiment, rear sole support 126 is substantially identical to rear sole support 26 shown in FIG. 2 except that it has horizontal grooves 128 on the exterior surfaces of each of the downwardly extending walls and no holes 42. The mounting member 160 shown in FIG. 17 is also identical to mounting member 60 shown in FIG. 2 except that protrusions 168 do not have bulbous ends.

Locking members 190 differ from those shown in FIG. 2 in that the hinges are eliminated. Instead, the exterior surfaces of each of the locking members 190 have a horizontal groove 192 that aligns with the exterior grooves 128 formed on the rear sole support. In addition, apertures 194 (FIG. 19A) are cylindrical in shape and need not have expanded interior portions since the protrusions 168 have no bulbous ends.

To lock the locking members in place, an elastic band 110 is stretched and fitted within the grooves 128 on the rear sole support and grooves 192 on the locking members. The elastic band 110 may be a separate component completely removable from the rear sole support, as shown in FIG. 17, or permanently secured to the rear sole support by, for example, enclosing one of the grooves 128 after the elastic band has been inserted therein. Also, the band may be pushed or rolled upward above grooves 128 on the rear sole support prior to detaching locking members 190, and then simply rolled downward to return to an in-groove position following reattachment. As a further option, the elastic band may be a removable or permanently attached strap fitted within the grooves and having opposing ends that may be latched together like a belt or ski boot latch.

As a further alternative (not shown), a U-shaped connector having opposite ends permanently attached to one end of both locking members 90 may be removably or permanently secured to the outer surface of either the front or rear wall of the rear sole support, as a substitute for the system involving hinges 98 on locking members 90. The elastic band and other alternatives to the hinged locking member can be used in all of the embodiments of the invention.

Figure 20:
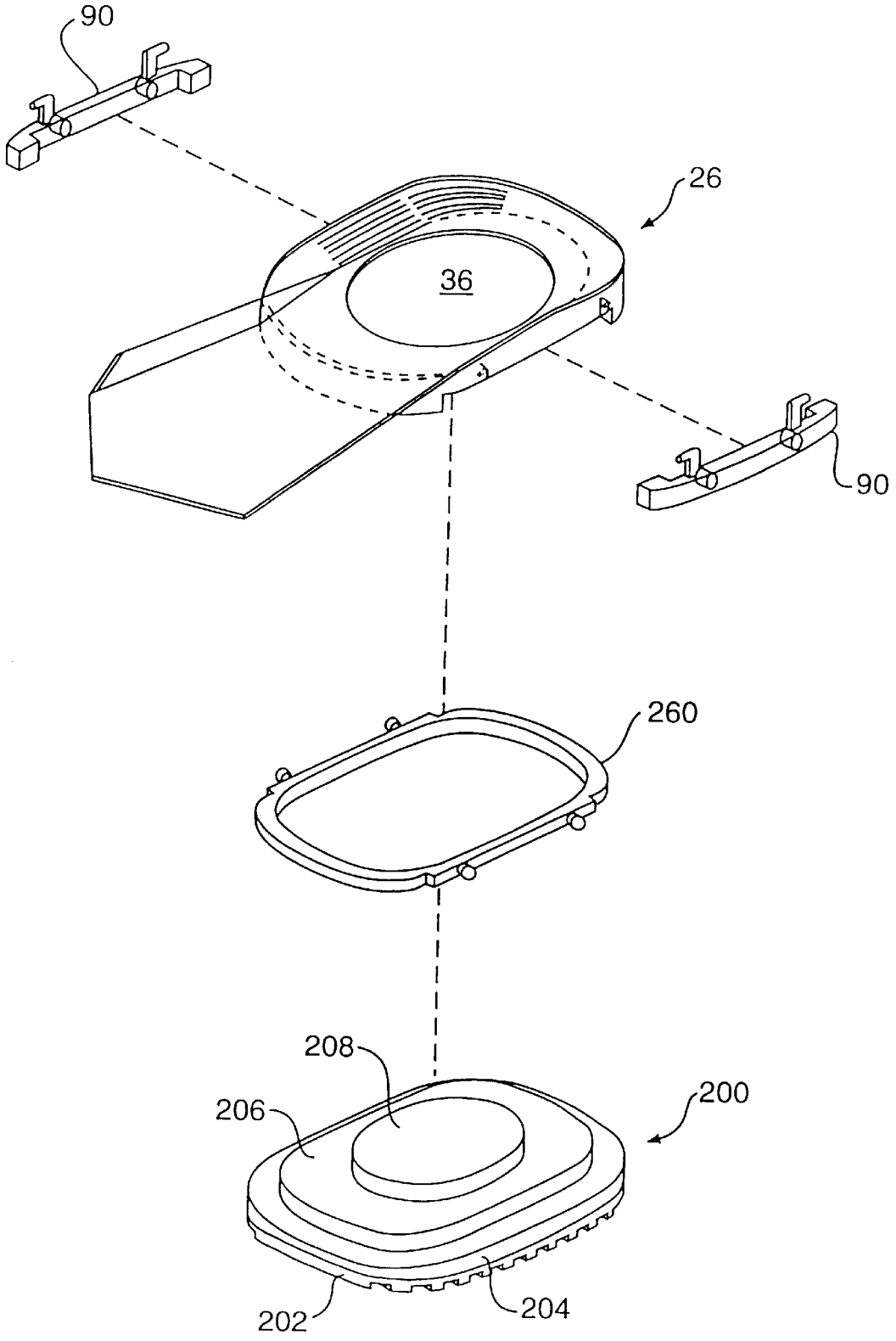
FIG. 20 is an exploded perspective view of another embodiment of the heel structure of the present invention.

If a flexible plate is not desired, the embodiment shown in FIG. 20 may be used to supply more conventional midsole cushioning. In this embodiment, the mounting member 260 is identical to the mounting member 60 shown in FIG. 2 except that the base layer 62 and slots 76 are eliminated. It should again be noted that the base layer 62 is an optional feature in all of the mounting member embodiments. In place of the rear sole 28 shown in FIG. 2, a rear sole 200 has an abrasion-resistant outsole 202 laminated to a midsole layer 204. On top of this midsole layer 204 are two additional midsole layers 206 and 208, each layer being smaller than the layer upon which it rests, with midsole layer 208 sized to fit within the central opening 36 in the rear sole support 26. Midsole layers 206 and 208 may comprise two separate pieces laminated together or a single piece molded or otherwise shaped to have two regions as shown.

In this embodiment, the mounting member 260 is adhered by gluing or other means to the top of the midsole layer 204 such that it surrounds and abuts against the sides of midsole layer 206. It may be further secured to the sides of midsole layer 206 by gluing or other means. The manner of attaching the rear sole and mounting member to the rear sole support is identical to that described with respect to the embodiment shown in FIG. 2. In addition, the top midsole layer 208 may, but need not be, made circular to facilitate rotation of the rear sole when the midsole layer 208 is pressed into the central opening 36. Alternatively, this layer may be severed from layer 206 and placed in opening 36 with the shoe in an inverted position. This may make installation easier if layer 208 is oval in shape, like opening 36. It also permits replacement of layer 208, should its cushioning properties deteriorate at a faster rate than the rest of the rear sole. Of course, this step would be accomplished before engagement of mounting member 260 with rear sole support 26, which similarly could be accomplished while the shoe is in an inverted position in order that layer 208 does not fall out or dislodge during installation.

It should be noted that layers 204, 206, and 208 may be made of different cushioning materials, including without limitation air-filled chambers, gell-filled chambers, EVA or polyurethane, or any combinations thereof.

The rear sole support is designed to accommodate a variety of rear sole configurations, which vary according to the activity involved, the weight of the user, and the cushioning and/or spring desired by the user. Although additional rear sole configurations are discussed below, many other rear sole configurations may be used in conjunction with the rear sole support 26.

Figure 21:
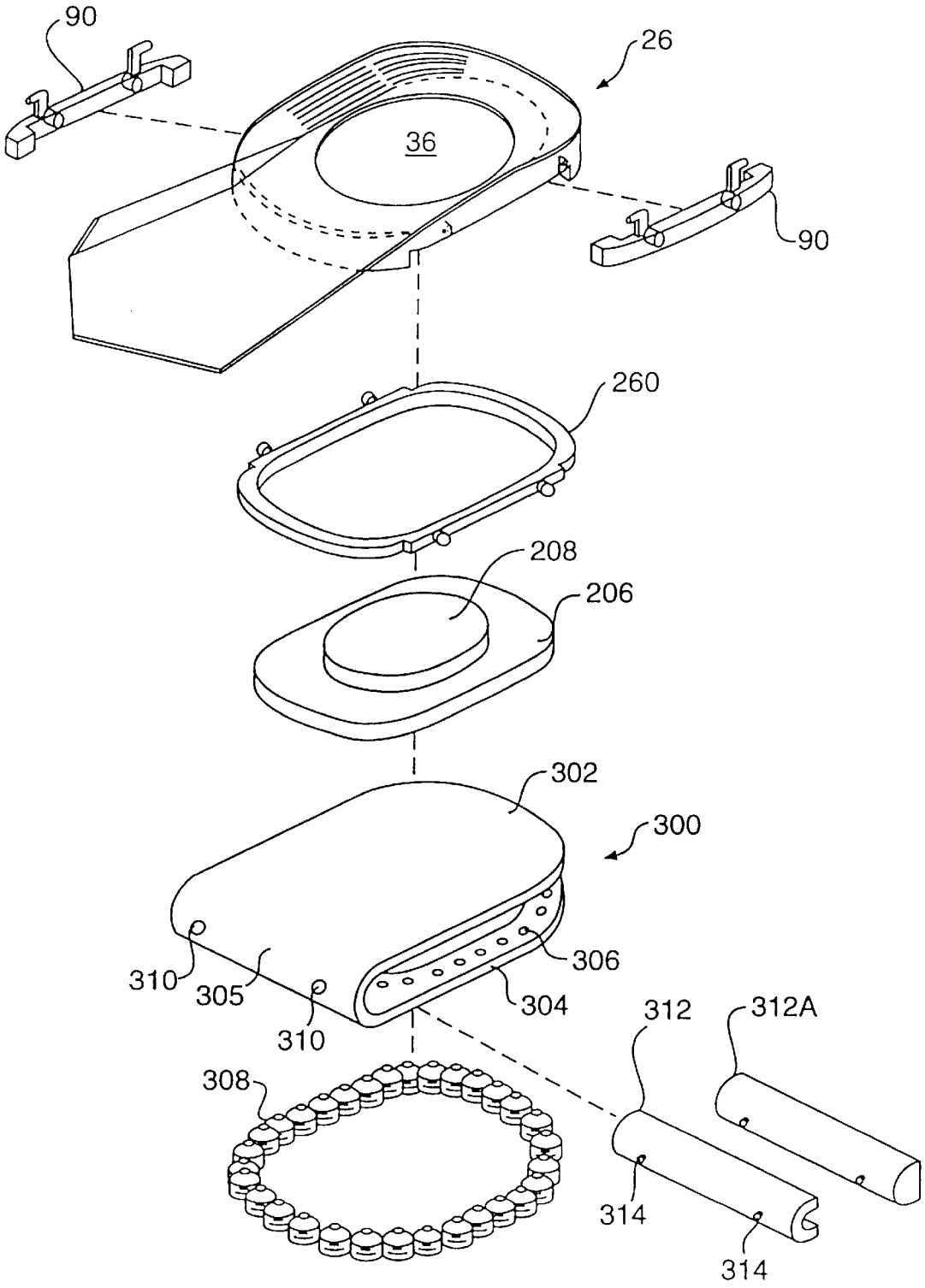
FIG. 21 is an exploded perspective view of another embodiment of the heel structure of the present invention.
Figure 22:
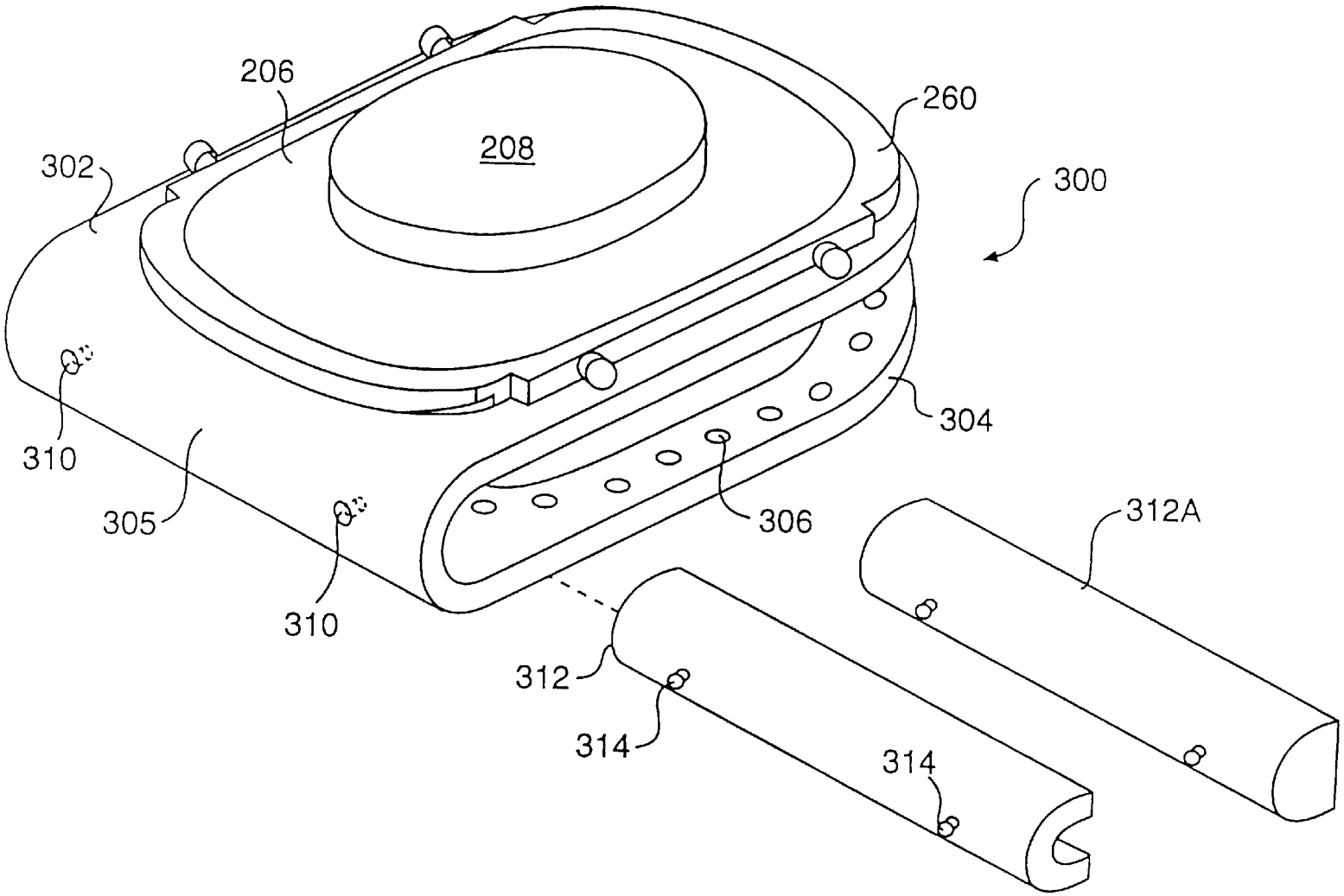
FIG. 22 is a perspective view of several of the heel components shown in FIG. 21.

One such example is shown in FIGS. 21 and 22. In this embodiment, a rear sole 300 is a U-shaped member having substantially parallel walls 302 and 304 joined by a bend 305. The member is composed of a stiff, but flexible, material that will provide spring to the heel of the user without sacrificing comfort. Materials such as those disclosed with respect to the flexible plate 80 may be used for the rear sole 300.

Two layers of resilient midsole material 206 and 208, which may be more resilient than the U-shaped member, are secured to the top of wall 302 by gluing or other means to provide cushioning to the heel of the user, and mounting member 260 is glued or otherwise attached to the top surface of top wall 302 to surround and abut against the sidewall of midsole layer 206. It may also be attached to the side wall of layer 206 by gluing or other means. The mounting member may also be molded to the rear sole 300 as a one-piece structure. The midsole layers 206 and 208, the mounting member 260, and the rear sole support 26 (as well as optional features) are identical to those shown in FIG. 20, and the manner and options for attaching the rear sole and mounting member to the rear sole support is the same, including without limitation the option of severing and separately installing layer 208.

Figure 23A:
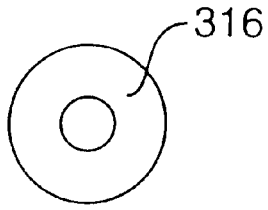
FIGS. 23A–C are top, side, and bottom views, respectively, of outsole segments for the heel structure shown in FIG. 21.
Figure 23B:
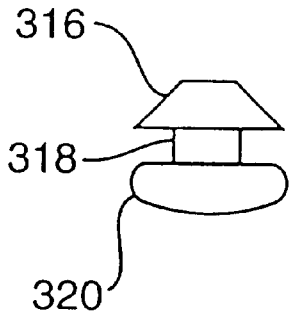
Figure 23C:
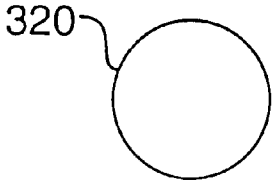

To protect the bottom ground-engaging surface of the U-shaped member and to provide cushioning, the rear sole may include an abrasion-resistant outsole which may be more resilient than the U-shaped member. As shown in FIG. 21, the bottom wall 304 of the rear sole 300 includes holes 306 through which removable outsole segments 308 are inserted. The outsole segments 308, which may be made of a rubber compound or other material typically used for outsole material, provide an abrasion-resistant layer for protecting the bottom surface of wall 304. As shown in FIGS. 23A–C, the outsole segments have a substantially conically-shaped top portion 316, a cylindrical middle portion 318, and a rounded ground-engaging portion 320. The conically-shaped portion 316 snaps into openings 306, and the bottom of the conically-shaped portion acts to retain the outsole segments in the openings. Alternatively, a one-piece outsole layer may be attached to the bottom surface of wall 304, utilizing openings 306 and segments 308, or eliminating both and utilizing gluing or some other means instead. Such outsole layer may then be permanent or removable.

The rear sole 300 provides spring to the heel of the user in the following manner. When the heel of the user strikes the ground, wall 304 will deflect toward wall 302. Since the material is elastic, energy stored in bend 305 and wall 304 during deflection will spring bend 305 and wall 304 back to their original position as weight is shifted, thereby providing a spring effect to the user's heel. Stiffening members 312 or 312A are optional elements that may be used to increase the spring generated by the rear sole 300. The stiffening members include protrusions 314 that engage apertures 310 in the bend of the rear sole 300. Alternatively, bottom wall 304 (shown with large hole in middle) may be solid to increase spring or may be tent-shaped as shown in FIG. 25 to further increase spring, with or without a stiffening member 412.

Figure 24:
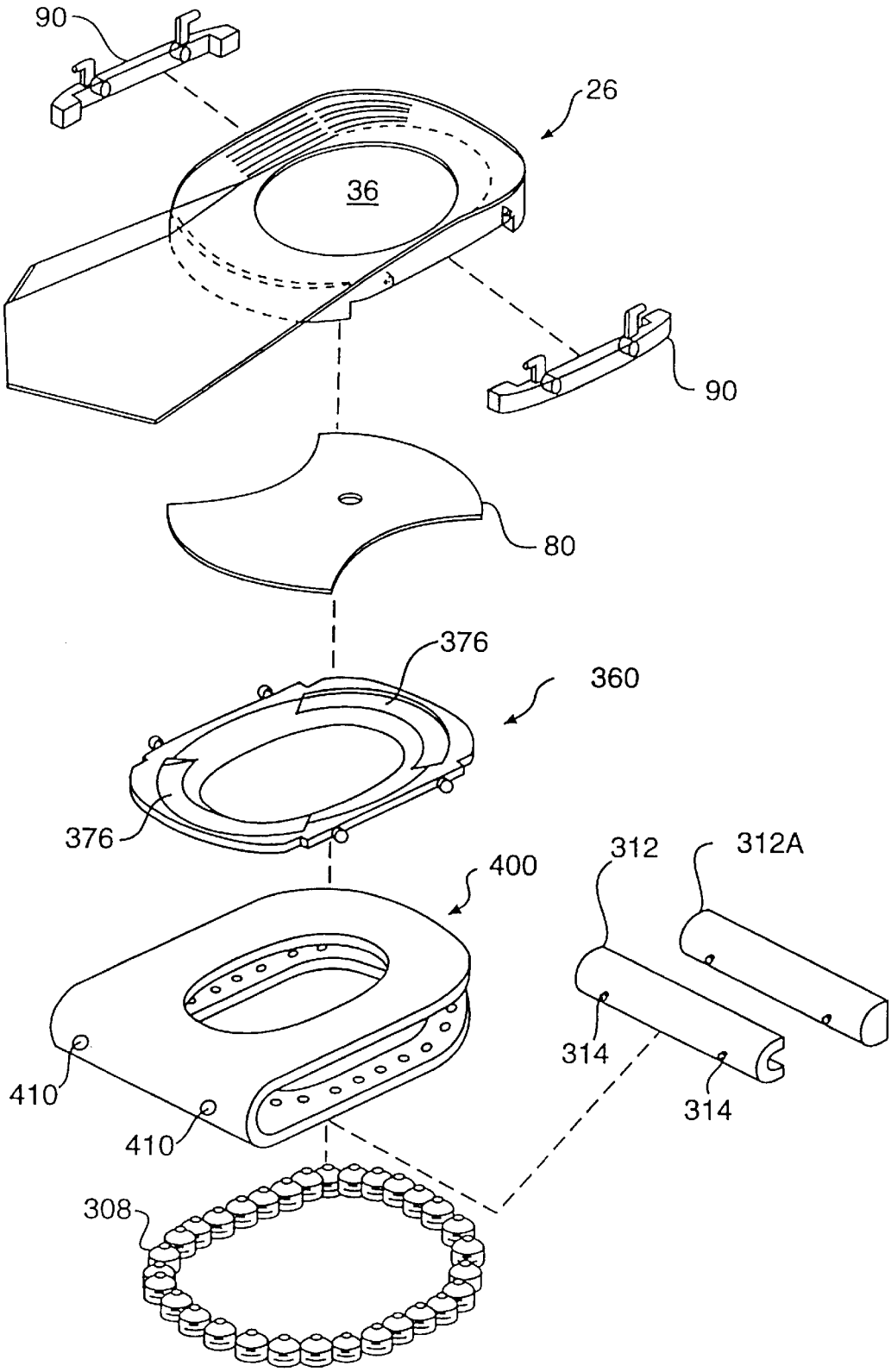
FIG. 24 is an exploded perspective view of another embodiment of the heel structure of the present invention.

Flexible plate 80 may also be used in conjunction with a rear sole very similar to that shown in FIG. 21. As shown in FIG. 24, rear sole 400 is identical to rear sole 300 shown in FIG. 21 except that it has an optional opening in the top wall to reduce the weight of the rear sole and allow additional space within which flexible plate 80 may flex. Alternatively, the bottom wall may be solid to increase spring or may be tent-shaped as shown in FIG. 25 to further increase spring, with or without a stiffening member 412. Mounting member 360 is similar to that shown in FIG. 2 except that the base 62 is deleted. Again, flexible plate 80 rests in slots 376 formed in the mounting member and is exposed to the heel region of the upper via the central opening 36 in the rear sole support 26.

Figure 25:
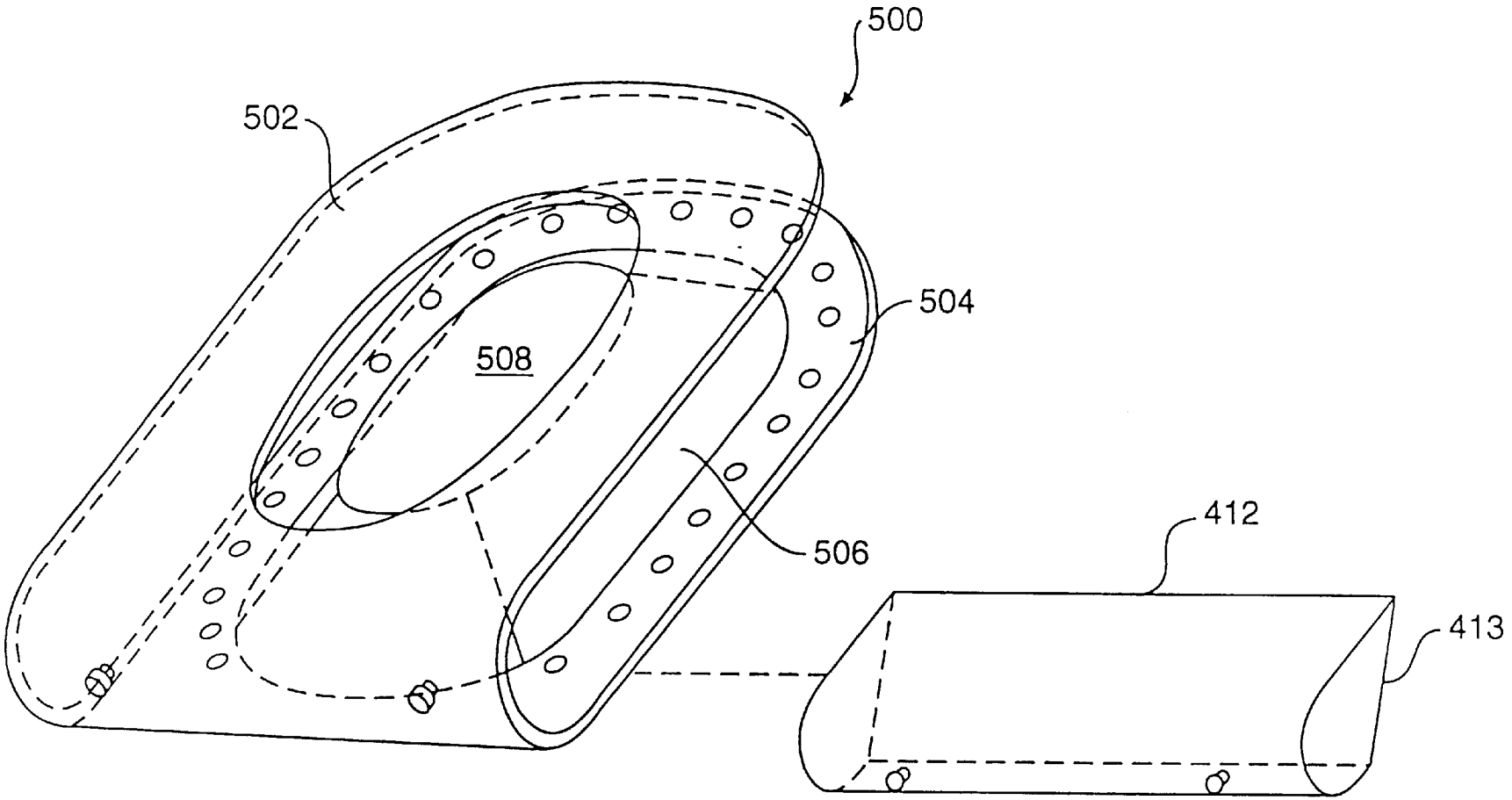
FIG. 25 is a perspective view of another embodiment of a rear sole for use with the shoe of the present invention.

Another rear sole option is shown in FIG. 25. In this embodiment, rear sole 500 is identical to rear sole 400 shown in FIG. 24 except that it has a "tent-like" wall 506 extending from the bottom wall 504 toward top wall 502. Wall 506 may have a top surface 508, or may be devoid of material at this location. Wall 506 has the effect of increasing stiffness and, therefore, provides more spring than that of the rear sole 400 as shown. A stiffening member 412 may also be used to further increase spring. Stiffening member 412 is identical to member 312 shown in FIG. 24 except that it has a slanted wall 413 to complement and press against the front sloped surface of wall 506. Top wall 502 may have a central opening, as shown in FIG. 25, or may be solid, such as wall 302 shown in FIG. 21. Wall 506 may be used in any of the U-shaped rear sole embodiments.

Figure 26:
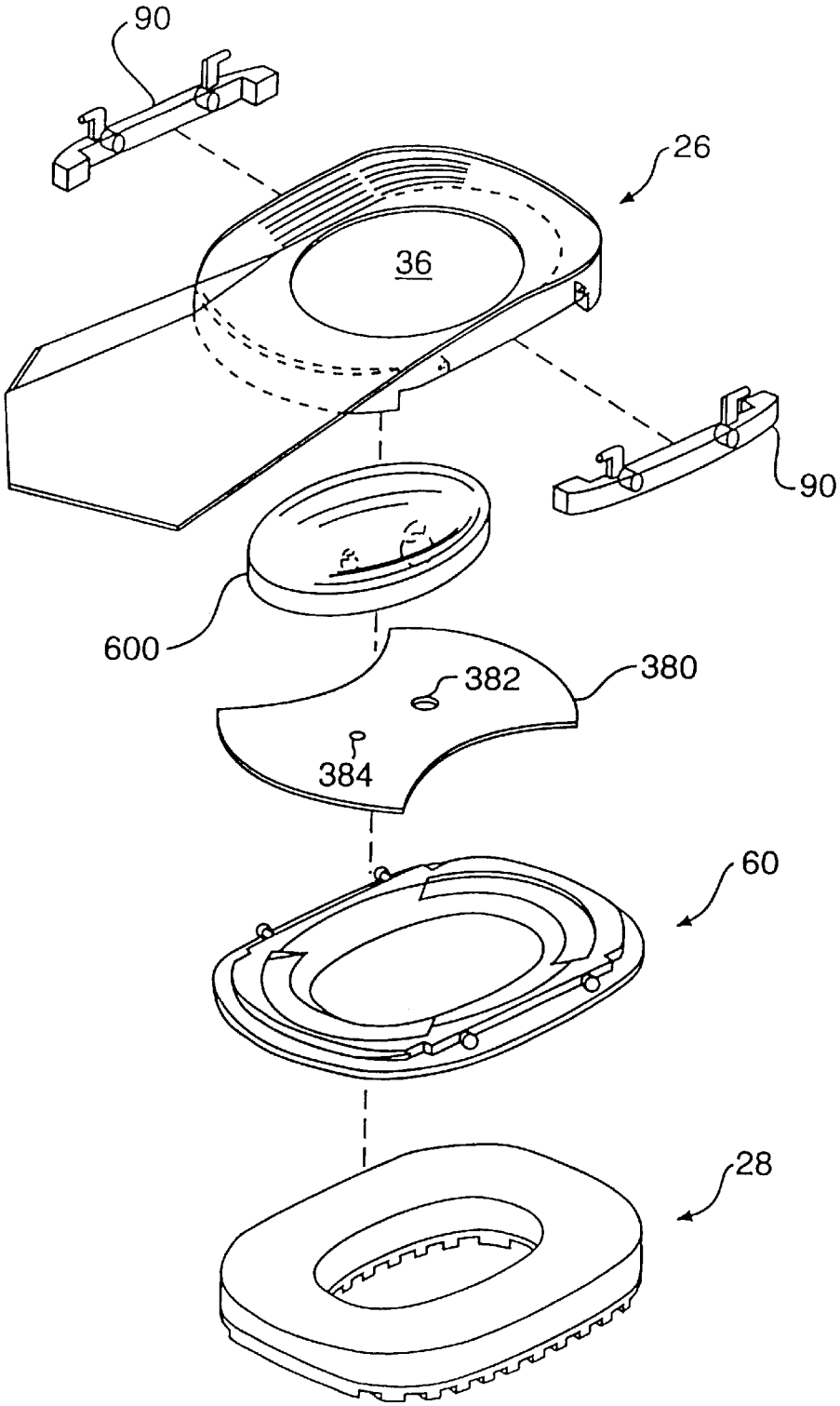
FIG. 26 is an exploded perspective view of another embodiment of a heel structure of the present invention.
Figure 27A:
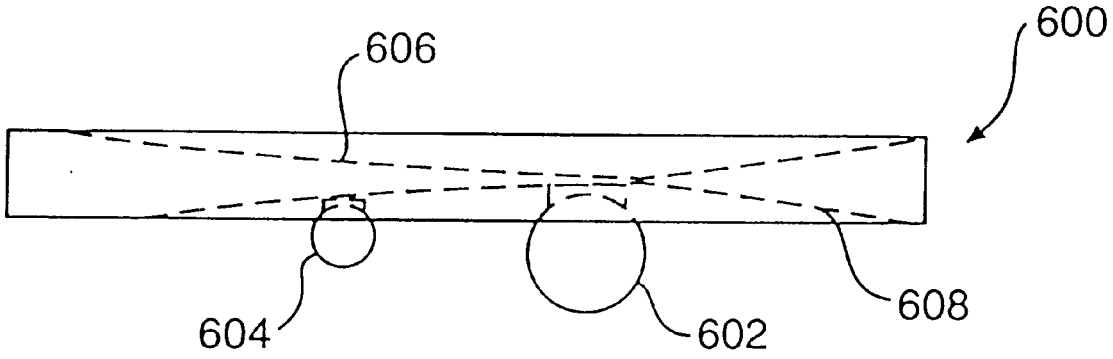
FIGS. 27A and 27B are side and front views, respectively, of a wafer for use in the heel structure shown in FIG. 26.
Figure 27B:
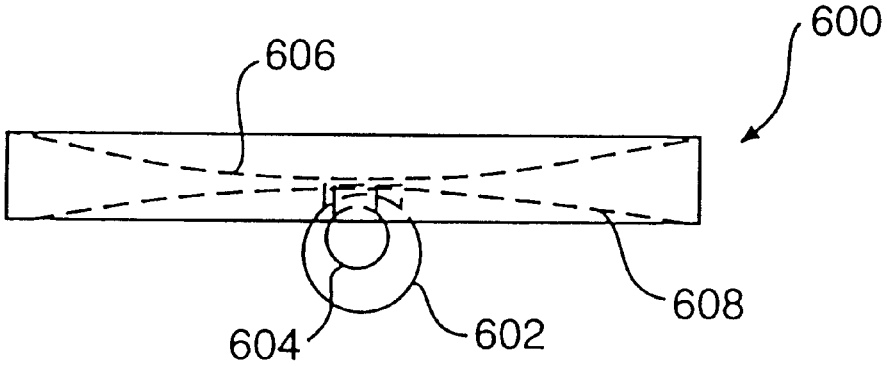

Finally, an optional wafer 600, usable in combination with any of the above embodiments incorporating a flexible plate, is disclosed in FIGS. 26–27B. As shown in FIG. 26, wafer 600 is disclosed in conjunction with the heel structure shown in FIG. 2. Wafer 600 is placed on the top surface of flexible plate 380 so that it is exposed to the heel region of the upper (not shown) via central opening 36 of rear sole support 26. Wafer 600 is made of any suitable materials, such as those materials disclosed for the midsole layer or outsole layer of rear sole 28, that provide cushioning to the heel of the user and which are more resilient than the flexible plate.

As shown in FIGS. 27A and 27B, wafer 600 includes knobs 602 and 604 that snap engage with corresponding openings 382 and 384 (see FIG. 26) in flexible plate 380. Although two knobs are shown in this embodiment, any number of knobs may be used; in fact, the knobs may be eliminated entirely.

As shown in FIG. 26, wafer 600 is oval in shape, although any shape is contemplated so long as it provides the desired cushioning to the heel of the user. If desired, the bottom surface 608 of wafer 600 may be concave in order to conform with the curved top surface of flexible plate 380. The top surface 606 of wafer 600 may also be concave in order to conform with the contours of the heel region of the upper or the user's heel.

The wafer need not be attached to the flexible plate 380. Instead, the wafer may, for example, be permanently attached to the bottom of the upper, secured within or made integral with a shoe sock liner (not shown), secured to the rear sole support, or attached at any other location that would be capable of cushioning the user's heel.

It will be apparent to those skilled in the art that various modifications and variations can be made in the shoe of the present invention without departing from the scope or spirit of the invention and that certain features of one embodiment may be used interchangeably in other embodiments. By way of example only, the rear sole support/locking member combinations shown in FIGS. 2 and 17 can be used in conjunction with any of the above-described rear sole configurations, and can be used with or without the flexible plate. Similarly, the arch bridge shown in FIGS. 1–4, upper and lower horizontal walls shown in FIGS. 5–7 and other alternatives to the arch bridge discussed herein may be employed with any embodiment shown. Thus, it is intended that the present invention cover all possible combinations of the features shown in the different embodiments, as well as modifications and variations of this invention, provided they come within the scope of the claims and their equivalents.

What is claimed is:

1. A shoe comprising:

an upper having a heel region;

a rear sole secured below the heel region of the upper;

a flexible plate having upper and lower surfaces and supported between at least a portion of the rear sole and at least a portion of the heel region of the upper, at least a portion of the lower surface of the flexible plate being concave in shape, at least a portion of the upper surface of the flexible plate being convex in shape, peripheral edges of the plate being restrained from movement relative to an interior portion of the plate in a direction substantially perpendicular to the major longitudinal axis of the shoe so that an interior portion of the plate is deflectable relative to the peripheral edges in a direction substantially perpendicular to the major axis of the shoe; and a cushion contacting and conforming to the upper surface of the flexible plate to provide cushioning to the heel of a user, the cushion having a peripheral portion and an interior portion, the peripheral portion of the cushion being thicker than the interior portion of the cushion.

2. The shoe of claim 1, wherein the cushion has a top surface adapted to conform to the heel of the user.

3. The shoe of claim 1, wherein the cushion has a top surface that is concave.

4. The shoe of claim 1, wherein the flexible plate is convex in shape with an upward curvature.

5. The shoe of claim 4, wherein the curvature has a center oriented beneath the user's heel.

6. The shoe of claim 1, wherein the upper surface of the flexible plate is convex.

7. The shoe of claim 6, wherein the cushion has a bottom surface that is concave.

8. The shoe of claim 1, wherein the cushion is integral with a midsole.

9. The shoe of claim 1, wherein the flexible plate is removable from the shoe.

10. The shoe of claim 1, further comprising means for removing the flexible plate from the shoe.

11. The shoe of claim 1, wherein the peripheral portion of the cushion is closer to the bottom of the rear sole than the interior portion of the cushion.

12. A shoe comprising:

an upper having a heel region;

a rear sole secured below the heel region of the upper;

a flexible plate having upper and lower surfaces and supported between at least a portion of the rear sole and at least a portion of the heel region of the upper, at least a portion of the lower surface of the flexible plate being concave in shape, at least a portion of the upper surface of the flexible plate being convex in shape, peripheral edges of the plate being restrained from movement relative to an interior portion of the plate in a direction substantially perpendicular to the major longitudinal axis of the shoe so that an interior portion of the plate is deflectable relative to the peripheral edges in a direction substantially perpendicular to the major axis of the shoe;

a sock liner; and a cushion contacting and conforming to the upper surface of the flexible plate to provide cushioning to the heel of a user, the cushion having a peripheral portion and an interior portion, the peripheral portion of the cushion being thicker than the interior portion of the cushion, the cushion contacting the sock liner.

13. The shoe of claim 12, wherein the sock liner is removable from the shoe to expose the flexible plate.

14. A shoe comprising:

an upper having a heel region;

a rear sole secured below the heel region of the upper;

a flexible plate having upper and lower surfaces and supported between at least a portion of the rear sole and at least a portion of the heel region of the upper, at least a portion of the upper surface of the flexible plate being convex in shape, peripheral edges of the plate being restrained from movement in a direction substantially perpendicular to a major longitudinal axis of the shoe so that an interior portion of the plate is deflectable relative to the peripheral edges in a direction substantially perpendicular to the major axis of the shoe; and a cushion contacting and conforming to the upper surface of the flexible plate to provide cushioning to the heel of a user, the cushion having a peripheral portion and an interior portion, the peripheral portion of the cushion being thicker than the interior portion of the cushion.

15. The shoe of claim 14, wherein the interior portion of the flexible plate is elevated relative to at least a portion of the peripheral portion.

16. The shoe of claim 14, wherein the cushion has a top surface adapted to conform to the heel of the user.

17. The shoe of claim 14, wherein the cushion has a top surface that is concave.

18. The shoe of claim 14, wherein the flexible plate is convex in shape with an upward curvature.

19. The shoe of claim 18, wherein the curvature has a center oriented beneath the user's heel.

20. The shoe of claim 14, wherein the upper surface of the flexible plate is convex.

21. The shoe of claim 14, wherein the cushion has a bottom surface that is concave.

22. The shoe of claim 14, wherein the cushion is integral with a midsole.

23. The shoe of claim 14, wherein the flexible plate is removable from the shoe.

24. The shoe of claim 14, wherein the flexible member is removable from the shoe.

25. A shoe comprising:

an upper having a heel region;

a rear sole secured below the heel region of the upper;

a flexible plate having upper and lower surfaces and supported between at least a portion of the rear sole and at least a portion of the heel region of the upper, at least a portion of the upper surface of the flexible plate being convex in shape, peripheral edges of the plate being restrained from movement in a direction substantially perpendicular to a major longitudinal axis of the shoe so that an interior portion of the plate is deflectable relative to the peripheral edges in a direction substantially perpendicular to the major axis of the shoe;

a sock liner; and a cushion contacting and conforming to the upper surface of the flexible plate to provide cushioning to the heel of a user, the cushion having a peripheral portion and an interior portion, the peripheral portion of the cushion being thicker than the interior portion of the cushion, the cushion contacting the sock liner.

26. The shoe of claim 25, wherein the sock liner is removable from the shoe to expose the flexible plate.

27. A shoe comprising:

an upper;

a cushion positioned beneath at least a portion of the upper, the cushion having a top surface and a bottom surface, each of the top and bottom surfaces having a peripheral portion and an interior portion, a dimension between the peripheral portion of the top and bottom surfaces as measured in a substantially vertical line oriented perpendicularly to a major longitudinal axis of the shoe being greater than a dimension between the interior portions of the top and bottom surfaces as measured in a substantially vertical line oriented perpendicularly to the major axis of the shoe, at least a portion of the bottom surface of the cushion being concave in shape; and a flexible member positioned beneath the cushion, the flexible member having an upper surface at least a portion of which is convex in shape, the flexible member having peripheral edges and substantially conforming to the shape of the concave portion of the bottom surface of the cushion.

28. The shoe of claim 27, wherein the concave portion of the bottom surface of the cushion and the convex portion of the upper surface of the flexible member abut each other.

29. The shoe of claim 27, further having a sole with a ground-engaging portion positioned beneath the flexible member, the peripheral portion of the bottom surface of the cushion being closer than the interior portion of the bottom surface of the cushion to the ground-engaging portion of the sole.

30. The shoe of claim 27, wherein the cushion is made of a material that is more resilient then the material of the flexible member.

31. The shoe of claim 27, wherein at least a portion of the top surface of the cushion is concave in shape.

32. The shoe of claim 27, wherein the concave portion of the bottom surface of the cushion and the convex portion of the upper surface of the flexible member have a curvature that is multi-directional.

33. The shoe of claim 27, wherein the concave portion of the bottom surface of the cushion and the convex portion of the upper surface of the flexible member have a curvature that is perpendicular to the major longitudinal axis of the shoe.

34. The shoe of claim 27, wherein the concave portion of the bottom surface of the cushion and the convex portion of the upper surface of the flexible member have a curvature that is parallel to the major longitudinal axis of the shoe.

35. The shoe of claim 34, wherein the convex portion of the upper surface of the flexible member occupies an area approximately the same size as the area occupied by a bottom of a wearer's heel.

36. The shoe of claim 34, wherein the concave portion of the bottom surface of the cushion occupies an area approximately the same size as the area occupied by a bottom of a wearer's heel.

37. The shoe of claim 34, wherein the convex portion of the upper surface of the flexible member includes a single curvature centered beneath a wearer's heel.

38. The shoe of claim 27, wherein the concave portion of the bottom surface of the cushion and the convex portion of the upper surface of the flexible member have a curvature that is parallel to the major longitudinal axis of the shoe and a curvature that is perpendicular to the major longitudinal axis of the shoe.

39. The shoe of claim 27, wherein the convex portion of the upper surface of the flexible member occupies an area approximately the same size as the area occupied by a bottom of a wearer's heel.

40. The shoe of claim 27, wherein the concave portion of the bottom surface of the cushion occupies an area approximately the same size as the area occupied by a bottom of a wearer's heel.

41. The shoe of claim 27, wherein the flexible member is convex in shape with an upward curvature.

42. The shoe of claim 41, wherein the curvature has a center oriented beneath the user's heel.

43. The shoe of claim 27, wherein the cushion is integral with a midsole.

44. The shoe of claim 27, wherein the flexible member is removable from the shoe.

45. The shoe of claim 27, wherein the interior portion of the flexible member is elevated relative to at least a portion of the peripheral portion.

46. The shoe of claim 27, further comprising a sock liner that is removable from the shoe to expose the flexible member.

* * * * *

UNITED STATES PATENT AND TRADEMARK OFFICE

CERTIFICATE OF CORRECTION

PATENT NO: 5,970,628

DATED: October 26, 1999

INVENTOR: David F. Meschan

It is hereby certified that an error appears in the above-identified patent and that said Letters Patent is hereby corrected as shown below:

Page 2, first column, the 29th reference listed, change "3,432,158 3/1969 McMahon et al." to read --4,342,158 8/1982 McMahon et al.—

Signed and Sealed this

First Day of May, 2001

*Attest:*

Nicholas P. Godici

NICHOLAS P. GODICI

*Attesting Officer*

*Acting Director of the United States Patent and Trademark Office*